US011113927B2

(12) United States Patent
Feng et al.

(10) Patent No.: US 11,113,927 B2
(45) Date of Patent: Sep. 7, 2021

(54) ELECTRONIC BETTING ASSISTANT AND METHODS THEREFOR

(71) Applicant: Empire Technology Group Limited, Las Vegas, NV (US)

(72) Inventors: Linyi Frank Feng, Las Vegas, NV (US); Daryn Kiely, Las Vegas, NV (US); Jeffrey E. Harris, Chino Hills, CA (US); Randy Graham, Las Vegas, NV (US)

(73) Assignee: Empire Technological Group Limited, Las Vegas, NV (US)

( * ) Notice: Subject to any disclaimer, the term of this patent is extended or adjusted under 35 U.S.C. 154(b) by 0 days.

(21) Appl. No.: 15/826,680

(22) Filed: Nov. 30, 2017

(65) Prior Publication Data

US 2019/0164381 A1 May 30, 2019

(51) Int. Cl.
*G07F 17/32* (2006.01)

(52) U.S. Cl.
CPC ..... *G07F 17/322* (2013.01); *G07F 17/3209* (2013.01); *G07F 17/3211* (2013.01); *G07F 17/3244* (2013.01); *G07F 17/3288* (2013.01)

(58) Field of Classification Search
CPC ..... G07F 17/322; G07F 17/3209; G07F 17/3211; G07F 17/3244; G07F 17/3288
USPC ..... 463/25
See application file for complete search history.

(56) References Cited

U.S. PATENT DOCUMENTS

| | | | |
|---|---|---|---|
| 4,814,589 | A | 3/1989 | Storch |
| 5,510,081 | A | 4/1996 | Edwards et al. |
| 5,735,742 | A | 4/1998 | French |
| D424,068 | S | 5/2000 | Takemasa |
| 6,332,099 | B1 | 12/2001 | Heidel |
| 6,425,817 | B1 | 7/2002 | Momemy |
| 6,464,584 | B2 | 10/2002 | Oliver |
| 6,530,836 | B2 | 3/2003 | Soltys et al. |
| 6,848,994 | B1 | 2/2005 | Knust |
| D518,213 | S | 3/2006 | Ping |

(Continued)

FOREIGN PATENT DOCUMENTS

WO WO 2017/203142 A1 11/2017

OTHER PUBLICATIONS

"Over", definition from Cambridge English Dictionary Online retrieved from Internet URL <https://dictionary.cambridge.org/us/dictionary/english/over>. (Year: 2019).*

(Continued)

*Primary Examiner* — Jay Trent Liddle
*Assistant Examiner* — Ryan Hsu

(57) ABSTRACT

An electronic apparatus that facilitates wagers (or bets) for gaming apparatus. The electronic apparatus can be referred to as an electronic betting assistant (or electronic wager assistant). The electronic apparatus can assist dealer and/or players in placing wagers. In one embodiment, the electronic apparatus can include an electronic scale that is configured to weigh one or more objects representing a wager (e.g., chips) and then utilize at least the weight to determine a value of the wager. The electronic apparatus can be used with a multi-player gaming apparatus such as a gaming table that provides a wager-based game. Advantageously, wagers are able to be more rapidly and conveniently placed such that wager-based games are able to operate more efficiently.

34 Claims, 13 Drawing Sheets

(56) References Cited

U.S. PATENT DOCUMENTS

| | | | | |
|---|---|---|---|---|
| 7,018,291 | B1 | 3/2006 | Lemke et al. | |
| 7,025,189 | B1 | 4/2006 | Petrusan | |
| 7,201,660 | B2 | 4/2007 | Kiely | |
| 7,351,145 | B1 * | 4/2008 | Ornstein | 273/309 |
| 7,559,839 | B2 * | 7/2009 | Bahar | G07F 17/32 273/274 |
| D628,199 | S | 11/2010 | Yukikado | |
| D628,913 | S | 12/2010 | Cheng | |
| D641,018 | S | 7/2011 | Lee | |
| D647,574 | S | 10/2011 | Zhang | |
| 8,157,643 | B1 | 4/2012 | Phan | |
| D669,076 | S | 10/2012 | Haller | |
| 8,282,480 | B2 | 10/2012 | Wells | |
| 8,430,733 | B2 | 4/2013 | Chang et al. | |
| 8,591,306 | B1 | 11/2013 | Kearns | |
| D698,353 | S | 1/2014 | Choi | |
| 8,814,681 | B2 | 8/2014 | Wells et al. | |
| 8,814,706 | B2 | 8/2014 | Wells et al. | |
| 8,968,086 | B2 | 3/2015 | Wells et al. | |
| D726,295 | S | 4/2015 | Kim | |
| 9,147,318 | B2 | 9/2015 | Tarantino | |
| 9,165,420 | B1 | 10/2015 | Heidel | |
| 9,240,100 | B2 | 1/2016 | Tarantino | |
| 9,292,996 | B2 | 3/2016 | Davis et al. | |
| D761,901 | S | 7/2016 | Kim | |
| 9,489,799 | B2 | 11/2016 | Saffari et al. | |
| D778,279 | S | 2/2017 | Pendise | |
| 9,754,455 | B2 | 9/2017 | Tarantino | |
| D811,488 | S | 2/2018 | To et al. | |
| 9,940,779 | B2 | 4/2018 | To et al. | |
| D824,906 | S | 8/2018 | Feng et al. | |
| D826,228 | S | 8/2018 | Feng et al. | |
| 2002/0045480 | A1 | 4/2002 | Soltys et al. | |
| 2002/0120572 | A1 | 8/2002 | Bellucci | |
| 2003/0058372 | A1 | 3/2003 | Williams | |
| 2003/0060280 | A1 | 3/2003 | Oles | |
| 2003/0089010 | A1 | 5/2003 | Wechter | |
| 2004/0033095 | A1 | 2/2004 | Saffari | |
| 2005/0026680 | A1 | 2/2005 | Gururajan | |
| 2006/0205498 | A1 | 9/2006 | Kogo | |
| 2008/0139274 | A1 | 6/2008 | Baerlocher | |
| 2008/0261699 | A1 | 10/2008 | Topham | |
| 2009/0075725 | A1 | 3/2009 | Koyama | |
| 2009/0082079 | A1 | 3/2009 | Kuhn | |
| 2009/0098932 | A1 | 4/2009 | Longway | |
| 2009/0253478 | A1 | 10/2009 | Walker | |
| 2010/0093429 | A1 | 4/2010 | Mattice | |
| 2010/0178989 | A1 | 7/2010 | Kuhn | |
| 2010/0244380 | A1 * | 9/2010 | Walker | A63F 3/00157 273/292 |
| 2010/0291675 | A1 | 11/2010 | Pease | |
| 2011/0050602 | A1 | 3/2011 | Jeong et al. | |
| 2011/0195775 | A1 | 8/2011 | Wells | |
| 2011/0195786 | A1 | 8/2011 | Wells | |
| 2011/0195792 | A1 | 8/2011 | Wells | |
| 2012/0094750 | A1 | 4/2012 | Kuo | |
| 2012/0208622 | A1 | 8/2012 | Delaney | |
| 2014/0370989 | A1 | 12/2014 | Acres | |
| 2015/0014925 | A1 | 1/2015 | Miller | |
| 2015/0375096 | A1 | 12/2015 | Jackson | |
| 2016/0071367 | A1 | 3/2016 | Litman | |
| 2016/0093135 | A1 | 3/2016 | Bond | |
| 2016/0328913 | A1 * | 11/2016 | Blazevic | G07F 17/3211 |
| 2017/0330136 | A1 | 11/2017 | Bratter | |
| 2018/0005486 | A1 | 1/2018 | Risnoveanu | |
| 2018/0068517 | A1 | 3/2018 | Drennan | |
| 2018/0189921 | A1 | 7/2018 | Feng | |
| 2018/0190063 | A1 | 7/2018 | Feng | |
| 2018/0190064 | A1 | 7/2018 | Feng | |
| 2019/0005768 | A1 | 1/2019 | Wilkinson | |

OTHER PUBLICATIONS

Dictionary.com, "vertical", Mar. 19, 2016 retrieved from Internet URL <www.dictionary.com/browse/vertical/> via waybackmachine.org on May 17, 2021. (Year: 2016).*

Office Action for U.S. Appl. No. 15/396,342, dated Apr. 12, 2019.

Restriction Requirement for U.S. Appl. No. 15/688,841, dated Mar. 4, 2019.

Office Action for U.S. Appl. No. 15/826,680, dated May 16, 2019.

Karami et al., "Image Matching Using SIFT, SURF, BRIEF and ORB: Performance Comparison for Distorted Images", In Proceedings of the 2015 Newfoundland Electrical and Computer Engineering Conference,St. johns, Canada, Nov. 2015.

Office Action for U.S. Appl. No. 15/688,841, dated Jul. 15, 2019.

Office Action for U.S. Appl. No. 15/396,308, dated Sep. 23, 2019.

Final Office Action for U.S. Appl. No. 15/396,342, dated Oct. 10, 2019.

Office Action for U.S. Appl. No. 15/826,680, dated Nov. 25, 2019.

Office Action for U.S. Appl. No. 16/200,636, dated Dec. 17, 2019.

Notice of Allowance for U.S. Appl. No. 15/688,841, dated Mar. 2, 2020.

Advisory Action for U.S. Appl. No. 15/826,680, dated Mar. 9, 2020.

Final Office Action for U.S. Appl. No. 15/396,308, dated Mar. 23, 2020.

Final Office Action for U.S. Appl. No. 16/200,636, dated Apr. 2, 2020.

* cited by examiner

ELECTRONIC BETTING ASSISTANT AND METHODS THEREFOR

CROSS REFERENCE TO OTHER APPLICATIONS

This application claims priority to U.S. Provisional Application No. 62/483,927, filed Apr. 10, 2017, and entitled "DISPLAY ASSEMBLY FOR RELEVANT MESSAGING FOR GAMING APPARATUS AND METHODS THEREFOR," which is incorporated herein for all purposes.

This application also claims priority to U.S. Provisional Application No. 62/441,104, filed Dec. 30, 2016, and entitled "DEALER AND GAMING APPARATUS CONTROL SYSTEM FOR GAMING ESTABLISHMENTS," which is incorporated herein for all purposes.

BACKGROUND OF THE INVENTION

Today, gaming establishments, such as casinos, operate gaming apparatus, such as gaming tables that provide casino table games. Casino table games are games of chance, such as Poker, Roulette, Black Jack, Craps, Baccarat, etc., often involve players sitting at a physical table using physical game objects (cards, dice, chips, etc.) to play the games.

To support such gaming tables, gaming establishments need to provide various support personnel as well as gaming supplies to gaming tables. For example, a gaming establishment might employ a full supporting staff of dealers, pit bosses, shift managers, cashier clerks, chip runners, waiters, service technicians, etc. to support its gaming tables.

In wagering on games of chance, a player sitting at a gaming table can place one or more bets by placing one or more chips at designated positions on the gaming table. Moreover, side bets can also often be placed on a result of the game of chance. These side bets can be from any of the players sitting at the gaming table or other persons standing nearby that are able to place a side bet. It is difficult and time consuming for dealers to receive, confirm and manage all such bets.

Accordingly, there is a need for improved approaches to assist players and/or dealers to receive, confirm and manage wagers being made on a game of chance (e.g., casino table game) operating on a multi-player gaming apparatus, such as a gaming table.

SUMMARY

Embodiments disclosed herein concern an electronic apparatus that facilitates wagers (or bets) for gaming apparatus. The electronic apparatus can be referred to as an electronic betting assistant (or electronic wager assistant). The electronic betting assistant can assist dealer and/or players in placing wagers. Advantageously, wagers are able to be more rapidly and conveniently placed such that use of the electronic apparatus is able to operate more efficiently.

In one embodiment, an electronic betting assistant can include an electronic scale that is configured to weigh one or more objects representing a wager (e.g., chips) and then utilize at least the weight to determine a value of the wager, namely, an amount of money represented by the one or more objects representing the wager. The electronic betting assistant can also include a visual output apparatus configured to provide a visual notification at the corresponding one of the player positions. The electronic betting assistant can also use a proximity sensor to detect an object on the electronic betting assistant. The proximity sensor can be used to activate the electronic betting assistant and/or assist with determining the value of a wager.

An electronic betting assistant can be used with a multi-player gaming apparatus such as a gaming table that provides wager-based games and that can supported by various electronic devices or appliances. Typically, the various electronic devices can be coupled together via a table network and then coupled to a central network having computerized or computer assisted game management systems. In one embodiment, each player position can have its own electronic betting assistant. The electronic betting assistant can assist a dealer in confirming wagers from players before such wagers are formally placed.

The invention can be implemented in numerous ways, including as a method, system, device, apparatus (including computer readable medium and graphical user interface). Several embodiments of the invention are discussed below.

As a wagering table for supporting wager-based table games, one embodiment can, for example, include at least: a table surface providing a gaming surface for a wager-based table game, the table surface supporting a plurality of player positions provided about the table surface; a plurality of electrical devices provided at said wagering table, the plurality of electrical devices supporting the wager-based table game; a table controller configured to control the plurality of electrical devices; and a plurality of electronic bet assistants, each of the electronic bet assistants being at least partially integrated into the table surface at or proximate to a corresponding one of the player positions. Additionally, each of the electronic bet assistants can include at least: an electronic scale; a visual output apparatus configured to provide a visual notification at the corresponding one of the player positions; a bet assistant controller; and a communication interface.

As a computer-implemented method for assisting a player of a wager-based game in wagering one or more objects on the wager-based game, one embodiment can, for example, include at least: detecting a weight of the one or more objects that the player intends to wager on the wager-based game; determining whether the wager-based game is presently accepting wagers on the wager-based game; permitting the player to make a wager on the wager-based game when the determining determines that the wager-based game is presently accepting wagers on the wager-based game; and estimating the wager that the player intends to wager on the wager-based game based on at least the weight of the one or more objects.

As a method for assisting a player of a wager-based game in wagering one or more objects on the wager-based game, one embodiment can, for example, include at least: detecting presence of one or more objects at a player bet area of a gaming table supporting play of the wager-based game; activating an electronic wager assistant for assisting the player to place a wager at the player bet area; determining whether the wager-based game is presently accepting wagers on the wager-based game; detecting a weight of the one or more objects that the player intends to wager on the wager-based game; determining whether the weight detected is within an acceptable weight range; determining a number of the one or more objects that the player intends to wager based on the weight detected; acquiring image data of the one or more objects that the player intends to wager; processing the image data to determine value of each of the one or more objects that the player intends to wager; determining an amount of the wager that the player intends to wage based on the determined number of the one or more objects and the determined value of each of the one or more objects; displaying the determined amount of the wager; and subsequently determining whether the determined amount of the wager as displayed is confirmed by the player and/or an operator of the wager-based game.

As an electronic bet assistant, one embodiment can, for example, include at least: an exposed outer surface; a digital scale coupled to the exposed outer surface; at least one visual indicator provided proximate to the exposed outer surface; a controller operatively connected to the digital scale and/or the at least one visual indicator; and an input/output interface, operatively connected to the controller, for communicating with another electronic device over a network. The controller can monitor the digital scale to enable a bet to be made. The digital scale can yield a weight of one or more objects that are placed on the exposed outer surface. The controller can also determine a money value of the one or more objects based at least in part by the weight of the one or more objects.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like elements, and in which.

DETAILED DESCRIPTION OF CERTAIN EMBODIMENTS

Figure 1:
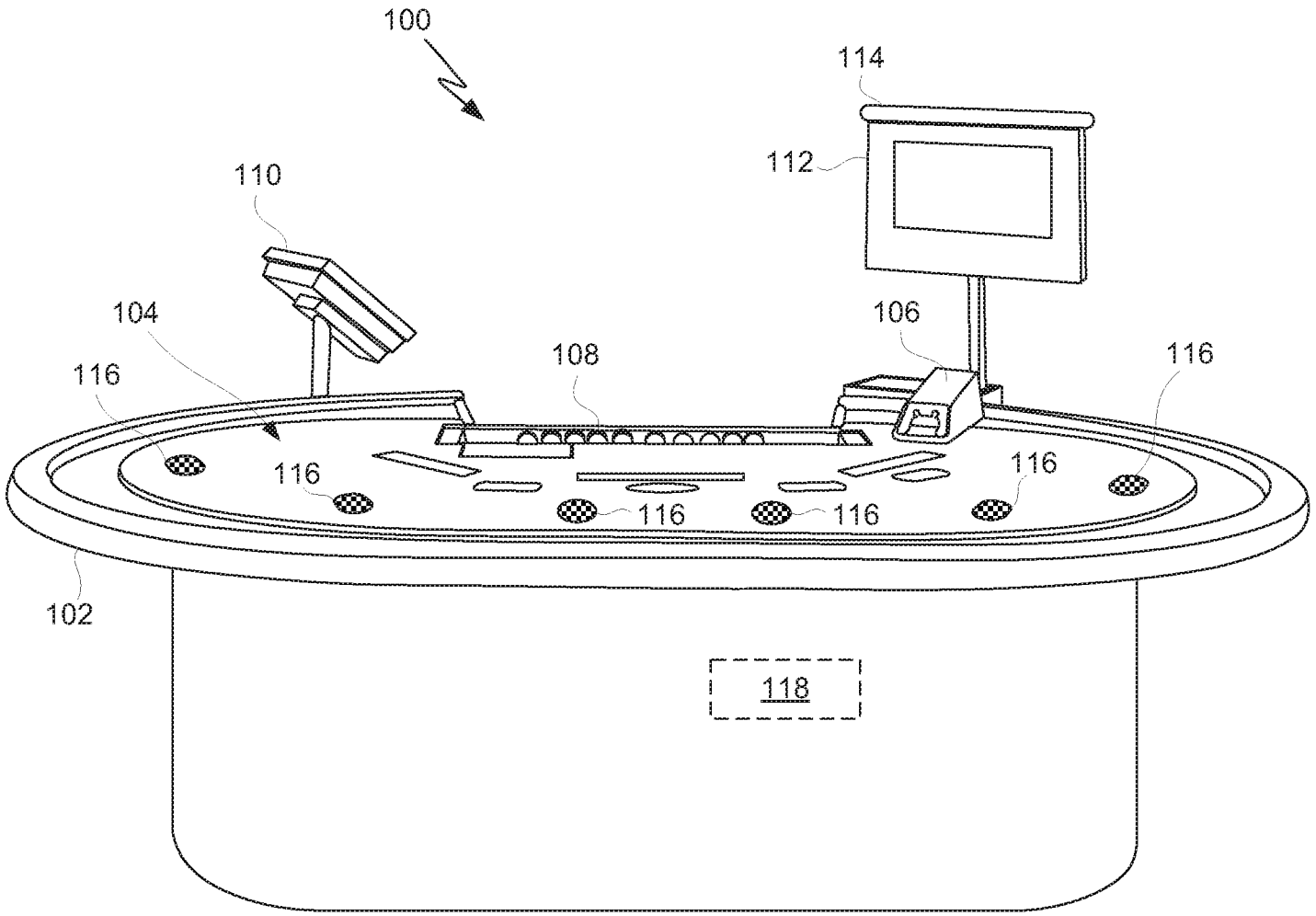
FIG. 1 is a perspective view of a gaming apparatus according to one embodiment.

Embodiments disclosed herein concern an electronic apparatus that facilitates wagers (or bets) for gaming apparatus. The electronic apparatus can be referred to as an electronic betting assistant (or electronic wager assistant). Consequently, wagers are able to be more rapidly and conveniently placed such that use of the electronic apparatus is able to operate more efficiently, particularly with multi-player gaming apparatus such as gaming tables. Examples of gaming apparatus include gaming tables, slot machines and video-based gaming machines.

Conventionally, a dealer at a gaming table is exclusively relied on to receive bets from players. Additionally, if the gaming table permits and supports side betting, even more wagers are potentially able to be placed. Many gaming tables support many players and substantial effort is required of the dealer to receive, conform and manage all the wagers. The electronic betting assistant disclosed herein can assist dealer and/or players in placing wagers. Advantageously, the electronic betting assistant can be used to assist in allowing wagers to be placed in a convenient and reliable manner and thus provides an improved user experience.

In one embodiment, an electronic betting assistant can include an electronic scale that is configured to weigh one or more objects representing a wager (e.g., chips) and then utilize at least the weight to determine a value of the wager, namely, an amount of money represented by the one or more objects representing the wager. The electronic betting assistant can also include a visual indicator to provide a visual notification to a person (e.g., player or dealer) of a state of the electronic betting assistant or a status of a wager. The electronic betting assistant can also include a display device to present at least wagering information to players. The display device can be integral, adjacent or proximate with the electronic betting assistant. The electronic betting assistant can also use a proximity sensor to detect an object on the electronic betting assistant. The proximity sensor can be used to activate the electronic betting assistant and/or assist with determining the value of a wager.

An electronic betting assistant can be used with a gaming table that provides wager-based games and that is supported by various electronic devices or appliances. Typically, the various electronic devices can be coupled together via a table network and then coupled to a central network having computerized or computer assisted game management systems. In one embodiment, each player position can have its own electronic betting assistant. The electronic betting assistant can assist a dealer in confirming wagers from players before such wagers are formally placed.

Embodiments of various aspects of the invention are discussed below with reference to FIGS. 1-10. However, those skilled in the art will readily appreciate that the detailed description given herein with respect to these figures is for explanatory purposes as the invention extends beyond these limited embodiments.

FIG. 1 is a perspective view of a gaming apparatus 100 according to one embodiment. The gaming apparatus 100 in this embodiment is a gaming table. The gaming table has a player table surface 102 that supports seven (7) player positions 104. The gaming apparatus 100 can include an electronic card shoe 106, a chip tray 108, a dealer terminal 110, a table display 112, and an edge display 114. The gaming apparatus 100 can also include one or more electronic betting assistants 116. For example, as shown in FIG. 1, the gaming apparatus 100 can provide an electronic betting assistant 116 at or proximate to each of the player positions 104 around the player table surface 102. The one or more electronic betting assistants 116 can serve to assist players and/or dealers with placing bets on wager-based games.

The gaming apparatus 100 can also include a gaming apparatus control system 118 that controls electronic operations at the gaming apparatus 100, including interaction with the electronic betting assistants 116. The gaming apparatus control system 118 is an electronic apparatus that can be programmed to provide various functions. Among other functions, as discussed below, the gaming apparatus control system 118 can interact with the electronic betting assistants 116. The gaming apparatus 100 can be referred to as an electronic gaming table since it makes use of a gaming table as well as various electronic devices.

The gaming apparatus 100 can support play of a game of chance, such as a wager-based game or a skill-based game, or some combination thereof. The gaming apparatus 100 can generally utilize gaming supplies in providing games of chance. The gaming supplies can include various gaming supplies that might be available for use at the gaming apparatus 100 to support a game of chance. For example, the gaming supplies include cash, cards and/or chips.

The gaming apparatus control system 118 can also provide electronic monitoring and/or management of the gaming apparatus 100 including (i) use of gaming supplies, bets, wins, and (ii) presenting (e.g., displaying) information to interested persons, such as player, dealers or managers, of gaming related information or dealer-related information. In doing so, the gaming apparatus control system 118 can include or couple to various electrical devices, such as a controller, sensors, displays, touch screens, buttons, lights, cameras, display interfaces, network interface(s), electronic support appliances (e.g., electronic shoe for cards, shuffler, card reader, chip tray, voucher printer, bill validator and the like), etc.

The gaming apparatus control system 118 can also provide or support multiple display devices to present information to interested persons. For example, the display devices can include (i) an apparatus display screen that can present information pertain to gaming currently or previously undergone at the gaming apparatus 100, often can also present near-term historical information, (ii) a player display for each player, and/or (iii) a messaging display often provided adjacent or proximate to the apparatus display. In one embodiment, a player display can provide notification or messages to players with text, images or colored lighting. In one embodiment, a messaging display can present its message with light sources that offer substantially greater intensity that light provided by the apparatus display screen. Advantageously, a message conveyed by the messaging display can be able to be seen and understood from a significant distance away (e.g., 20-120 feet), whereas the information presented by the apparatus display is designed for nearby persons (e.g., less than 15 feet). Further, as discussed herein, the electronic betting assistant 116 can also, in some embodiments, include a display device that presents information to a player.

Although FIG. 1 illustrates one electronic betting assistant 116 per player, in another embodiment, there can be two or more electronic betting assistants 116 per player, and for a given player these two or more electronic betting assistants 116 can be electrically connected and commonly controlled. For example, with two electronic betting assistants per player, the player can separately place a primary bet and also a secondary or auxiliary bet.

Figure 2:
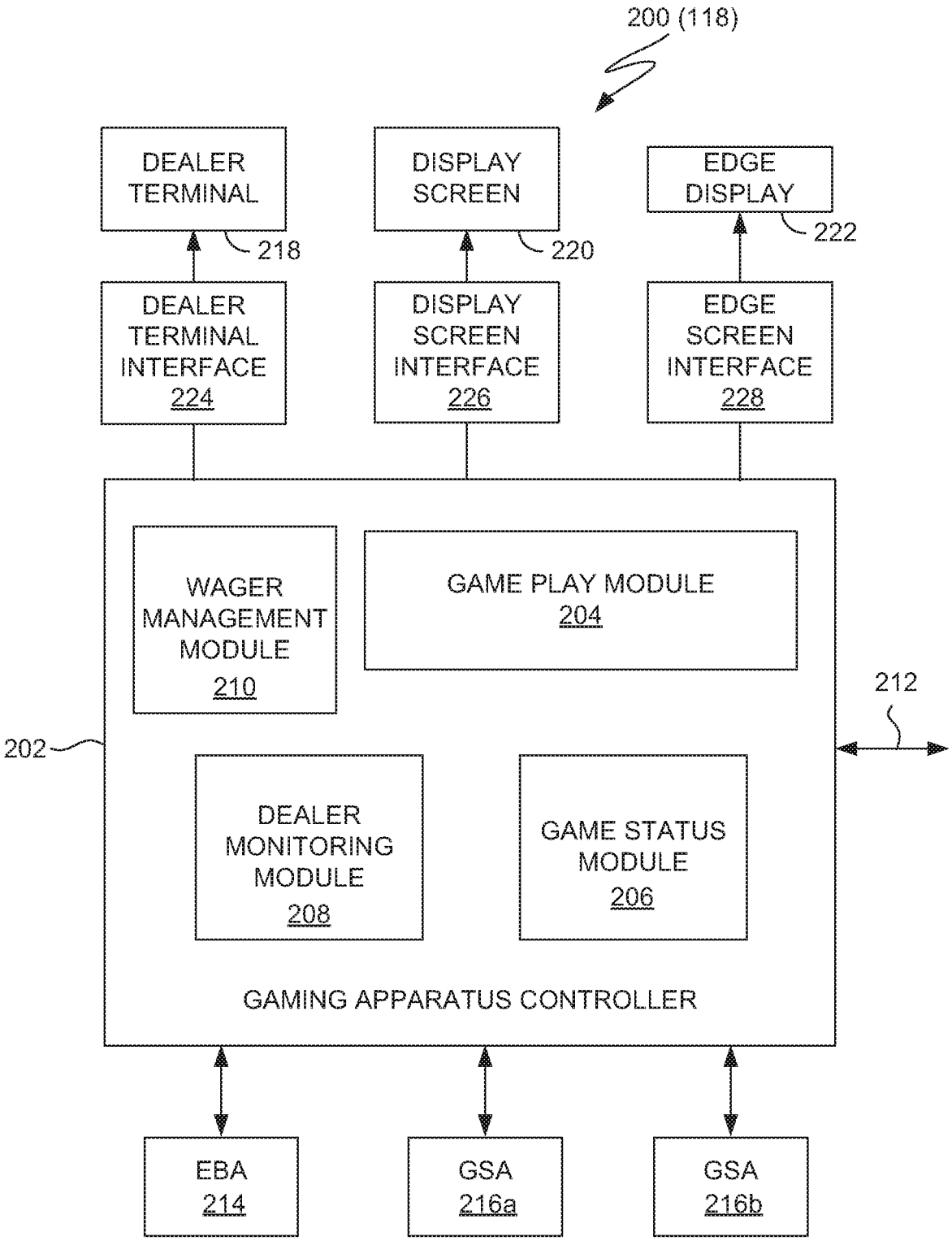
FIG. 2 is a block diagram of a gaming apparatus control system according to one embodiment.

FIG. 2 is a block diagram of a gaming apparatus control system 200 according to one embodiment. The gaming apparatus control system 200 is, for example, suitable for use as the gaming apparatus control system 118 illustrated in FIG. 1. Typically, the gaming apparatus control system 200 is associated with a gaming apparatus, such as the gaming apparatus 100 illustrated in FIG. 1. The gaming apparatus control system 200 includes a gaming apparatus controller 202 that controls overall operation at the gaming apparatus to which the gaming apparatus control system 200 is coupled. The gaming apparatus controller 202 is an electronic device that can include various functional components, such as modules, that are used by the gaming apparatus control system 200 to perform various operations.

As illustrated in FIG. 2, the gaming apparatus controller 202 can include a game play module 204, a game status module 206 and a dealer monitoring module 208. The game play module 204 can, for example, serve to manage game play at the gaming apparatus associated with the gaming apparatus control system 200. The game status module 206 can monitor status of one or more wager-based games being performed at the gaming apparatus. For example, the game status module 206 could monitor game state (of wager-based game), gaming supplies, player stats, dealt cards, winners, winning streaks, and the like. The dealer monitoring module 208 can, for example, monitor dealer status. In one embodiment, the gaming apparatus supports the play of one or more wager-based games that are operated by a dealer resident at the gaming apparatus (so called "live dealer"). Hence, the dealer monitoring module 208 can additionally or alternatively serve to monitor the status of the dealer, such as dealer performance, dealer breaks, dealer requests, dealer shift changes, and the like.

The gaming apparatus controller 202 can also include a wager management module 210. The wager management module 210 can assist a dealer and/or player with placing wagers (bets) at the gaming apparatus. For example, the wager management module 210 can coordinate play of wager-based games by various players, facilitate receipt and confirmation of wagers by players, facilitate confirmation and acceptance of wagers by a dealer, and/or monitor performance of such wagers. The wagers being placed can be for a primary game at the gaming apparatus, a side bet at the gaming apparatus, or even an auxiliary bet on a wager-based game operating on another gaming apparatus.

The gaming apparatus controller 202 can also be coupled to a central gaming server via a network link 212. The network link 212 can represent one or more networks and/or one or more network links, whether wired or wireless.

The gaming apparatus controller 202 can support an electronic betting assistant 214. The electronic betting assistant 214 is an electronic device that can be used to receive wagers (bets) from player. The electronic betting assistant 214 can be configured to receive one or more gaming objects (e.g., chips) used to place a wager (bet). The electronic betting assistant 214, alone or with the gaming apparatus controller 202 (e.g., the wager management module 210), can also determine a value (i.e., monetary value) of a wager being placed. In one embodiment, the electronic betting assistant 214 includes one or more electronic sensors that serve to capture data that can be evaluated to make a determined of the value of the wager. For example, the electronic sensors can include one or more of a weight sensor (e.g., electronic scale), a proximity sensor, and an image sensor (e.g., camera). In some embodiments, the electronic betting assistant 214 can also include a notification component, such as a display or illumination elements, to provide notifications (e.g., illumination of graphics and/or text) to a player or dealer. Although FIG. 2 illustrated the electronic betting assistant 214, it should be recognized that the gaming apparatus control system 200 can include a plurality of electronic betting assistants and that the gaming apparatus controller 202 can support the plurality of electronic betting assistants.

The gaming apparatus controller 202 can also be assisted by one or more gaming support appliances 216. The gaming support appliances 216 can couple to the gaming apparatus controller 202 by either wired or wireless means. Examples of gaming support appliances include an electronic shoe, an electronic lock, an electronic chip tray, etc. As shown in FIG. 2, the gaming apparatus control system 200 includes gaming support appliance 216*a* and gaming support appliance 216*b*. The electronic betting assistant 214 can also be considered a gaming support appliance.

The gaming apparatus control system 200 can convey information to a dealer, managers, or players (including potential players, i.e., bystanders). To do so, the gaming apparatus control system 200 can support one or more display devices. In the embodiment illustrated in FIG. 2, the gaming apparatus control system 200 supports a dealer terminal 218, a display screen 220, and an edge display 222. These display devices can be individually controlled to provide pertinent information to the dealer, managers, or players. For example, the dealer terminal 218 can display information suitable or useful for the dealer operating the gaming apparatus. The display screen 220 can display information suitable or useful for the players that are playing wager-based games at the gaming apparatus. For example, the display screen 220 can display wins, winning streaks, bets, and various other gaming related data. The edge display 222 can display information suitable for anyone in the vicinity of the gaming apparatus, which can include the dealer, players and managers.

In order to control the display devices, the gaming apparatus control system 200 can further include a dealer terminal interface 224, a display screen interface 226 and an edge display interface 228. The dealer terminal interface 224 provides an interface to the dealer terminal 218. The display screen interface 226 provides an interface to the display screen 220. The edge display interface 228 provides an interface to the edge display 222. These interfaces can facilitate control over what information is presented on the various display devices. The interfaces can, for example, include controllers, drivers, memory, and the like. Although the various interfaces and display screens are shown separately, in other embodiments it is possible that one or more of these interfaces and/or displays can be integrated together, shared or provided adjacent one another.

Figure 3:
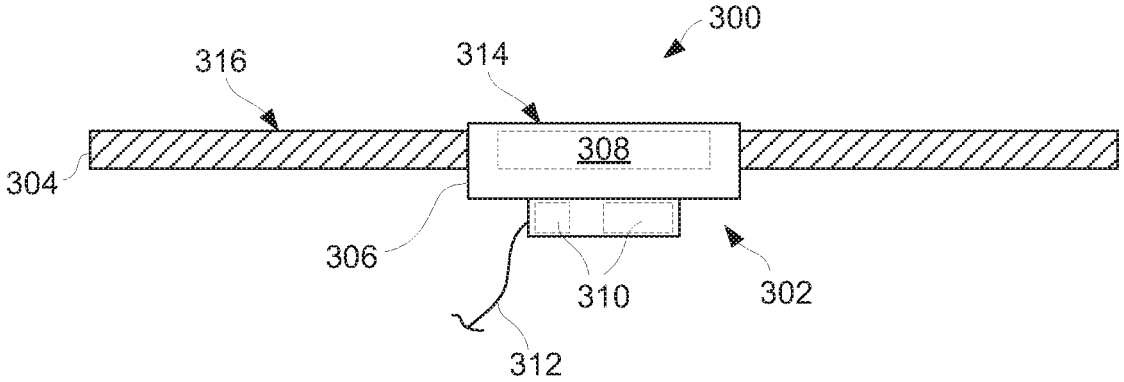
FIG. 3 is block diagram of a portion of a gaming apparatus according to one embodiment.

FIG. 3 is block diagram of a portion of a gaming apparatus 300 according to one embodiment. The gaming apparatus 300 includes an electronic betting assistant 302. The electronic betting assistant 302 is illustrated assembled in a structure 304 of a gaming apparatus. The electronic betting assistant 302 has a housing 306 that can include an electronic scale 308 and one or more other electrical components 310. The electronic betting assistant 302 can be coupled to a network and/or powered via a cable 312. The electronic scale 308 and the one or more other electrical components 310 can operate to provide operation of the electronic betting assistant 302 to facilitate receiving, evaluating, confirming and/or placing of wagers (or bets) for players.

In one implementation, the structure 304 can be a gaming table of a table-based gaming apparatus. In such case, the gaming table (structure 304) can include an opening configured to receive the housing 306 of the electronic betting assistant 302. An exposed outer surface 314 of the electronic betting assistant 302 can receive a wager (bet) from a player seeking to place a wager. The value of the wager can then be determined by the electronic betting assistant 302, alone or with assistance of other electrical devices. In one implementation, the exposed outer surface 314 of the electronic betting assistant 302 can be substantially flush or planar with an exposed upper surface of the structure 304 (e.g., playing surface of gaming table).

Figure 4A:
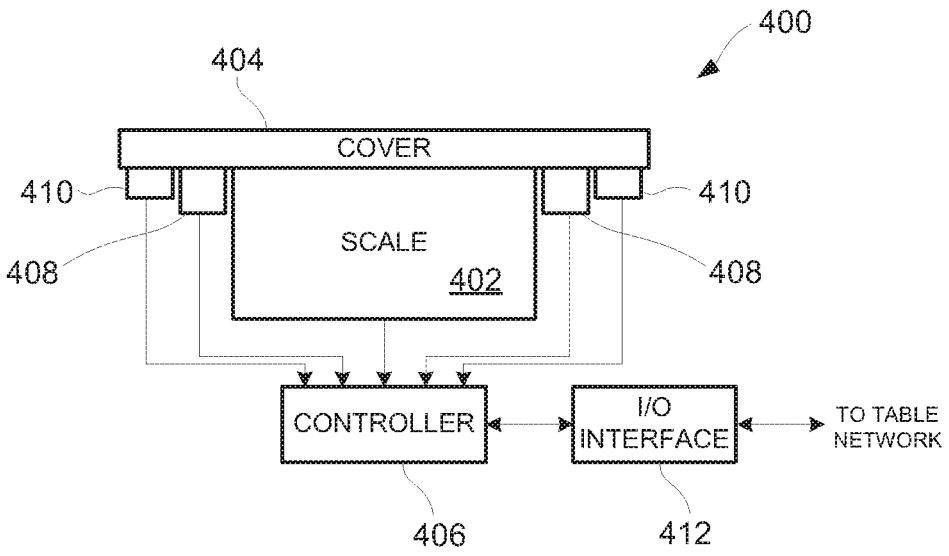
FIG. 4A is block diagram of an electronic betting assistant according to one embodiment.

FIG. 4A is block diagram of an electronic betting assistant 400 according to one embodiment. The electronic betting assistant 400 is suitable for use as any of the electronic betting assistants 116 illustrated in FIG. 1, the electronic betting assistant 214 illustrated in FIG. 2, or the electronic betting assistant 302 illustrated in FIG. 3.

The electronic betting assistant 400 includes a scale 402 for measuring a weight of one or more gaming objects. A cover 404 is provided on the scale 402 to provide a uniform outer surface for receiving the one or more gaming objects associated with a given wager. In one embodiment, the cover 404 can be transparent or semi-transparent. For example, the cover 404 can be glass or plastic. However, in other embodiments, the cover 404 can be other materials, such as wood, plastic, metal, etc., which may or may not be transparent. The scale 402 is an electronic scale (or digital scale) that can provide an electrical output that is dependent on the weight of object(s) placed on the scale 402. In this embodiment, the cover 404 can be secured on an upper weighing surface of the scale 402 so that the cover 404 provides the uniform outer surface. Hence, placing object(s) on the cover 404 also effectively places an object on the scale 402. Processing or calibration can be used to provide a weight offset or adjustment due to the weight of the cover 404 appearing on the scale 402.

The electronic betting assistant 400 can also include a controller 406. The controller 406 is programmed or constructed to provide control over the electronic betting assistant 400. The controller 406 reads or receives a digital or analog weight value from the scale 402. The controller 406 can perform processing to validate the weight value. The controller 406 can also then perform processing to determine the corresponding money value of the given wager. Additional details on an electronic betting assistant or operation of its processor are discussed below.

The electronic betting assistant 400 can also include one or more proximate sensors 408. Data from the one or more proximity sensors 408 are provided to the controller 406. The proximity sensors 408 generally can be any sensor that can detect presence or proximity of an object. Examples of proximity sensors include optical sensors, infrared sensors, magnetic sensors, capacitance sensors, a camera, etc. In some implementations, the weight change detected at the scale can be used as a presence sensor. The object being detected is preferably the gaming objects, but it is not necessary that the nature of the object be known.

Further, the electronic betting assistant 400 can also include one or more visual indicators 410. The one or more visual indicators 410 can provide visual notifications via the electronic betting assistant 400. In one implementation, the one or more visual indicators 410 can serve to illuminate a peripheral portion of the electronic betting assistant 400. For example, as depicted in FIG. 4A, the one or more visual indicators 410 can be positioned below and adjacent a peripheral surface of the cover 404, where the cover 404 is at least partially transparent or translucent. Alternatively or additionally, the one or more visual indicators can be provided adjacent the periphery of the cover 404. In another alternative, the one or more visual indicators 410 can be integral or embedded in the cover 404 or the electronic scale 402.

The electronic betting assistant 400 can also include an Input/Output (I/O) interface 412. The I/O interface 412 allows the electronic betting assistant 400 to electronically communicate with other electronic devices, such as over a network (e.g., a table network provided at a gaming table). The network can be a wired network or a wireless network.

As noted above, an electronic betting assistant can be provided with a gaming table. For example, an opening in a gaming table can receive the electronic betting assistant. As received, the electronic betting assistant can be positioned and secured to be substantially flush or planar with a table surface of the gaming table. In one embodiment, an electronic betting assistant is configured to receive bets from one player, and in such case, the gaming table would typically include a plurality of electronic betting assistants. As one example, each player position at the gaming table can have one electronic betting assistant. As another example, each player position at the gaming table can have a plurality of electronic betting assistants. As yet another embodiment, each electronic betting assistant can have a plurality of separate scales that can be used for receiving distinct bets (e.g., primary bet, side bet or auxiliary bet) from one player.

Figure 4B:
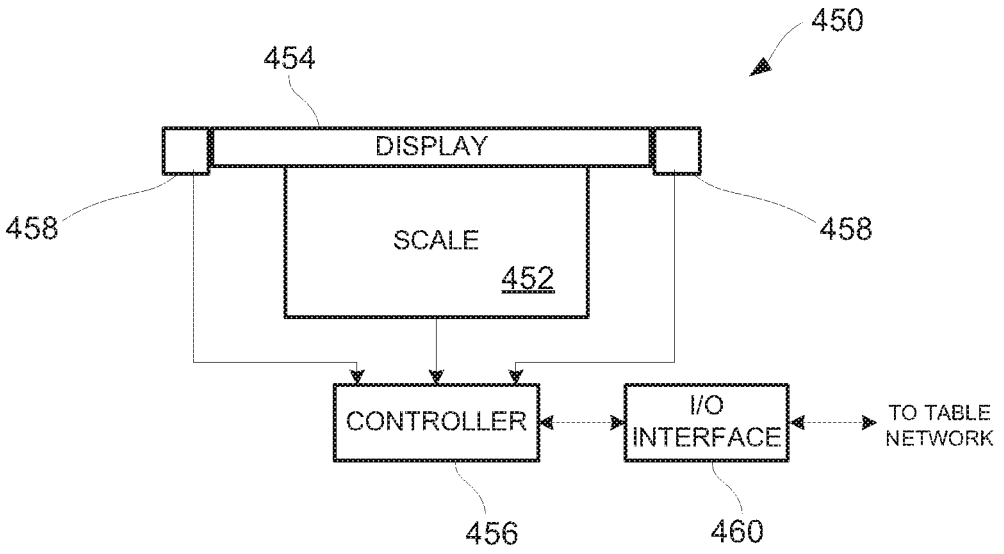
FIG. 4B is block diagram of an electronic betting assistant according to one embodiment.

FIG. 4B is block diagram of an electronic betting assistant 450 according to one embodiment. The electronic betting assistant 450 is suitable for use as any of the electronic betting assistants 116 illustrated in FIG. 1, the electronic betting assistant 214 illustrated in FIG. 2, or the electronic betting assistant 302 illustrated in FIG. 3.

The electronic betting assistant 450 includes a scale 452 for measuring a weight of one or more gaming objects. A display 454 is provided on the scale 452 to provide a display area where text and/or images can be displayed. The display 454 can also provide a top surface for receiving the one or more gaming objects associated with a given wager. In one embodiment, the display 454 can be a LCD display. For example, the display 454 can be a round display that has a diameter of 1-5 inches. However, in other embodiments, the display 454 can other shapes and sizes. The scale 452 is an electronic scale (or digital scale) that can provide an electrical output that is dependent on the weight of object(s) placed on the scale 452. In this embodiment, the display 454 can be secured on an upper weighing surface of the scale 452 so that the display 454 provides the top surface. Hence, placing object(s) on the display 454 also effectively places an object on the scale 452. Processing or calibration can be used to provide a weight offset or adjustment due to the weight of the display 454 appearing on the scale 452.

The electronic betting assistant 450 can also include a controller 456. The controller 456 is programmed or constructed to provide control over the electronic betting assistant 450. The controller 456 reads or receives a digital or analog weight value from the scale 452. The controller 456 can perform processing to validate the weight value. The controller 456 can also then perform processing to determine the corresponding money value of the given wager. Additional details on an electronic betting assistant or operation of its processor are discussed below.

Further, the electronic betting assistant 450 can also include one or more visual indicators 458. The one or more visual indicators 458 can provide visual notifications via the electronic betting assistant 450. In one implementation, the one or more visual indicators 458 can serve to illuminate a peripheral portion of the electronic betting assistant 450. For example, as depicted in FIG. 4B, the one or more visual indicators 458 can be coupled to or placed adjacent to an outer periphery of the display 454. In another alternative, the one or more visual indicators 458 can be integral or embedded in the display 454. The one or more visual indicators 458 can also be considered as an illuminable bezel for the display 454.

The electronic betting assistant 450 can also include an Input/Output (I/O) interface 460. The I/O interface 460 allows the electronic betting assistant 450 to electronically communicate with other electronic devices, such as over a network (e.g., a table network provided at a gaming table). The network can be a wired network or a wireless network.

As noted above, an electronic betting assistant can be provided with a gaming table. For example, an opening in a gaming table can receive the electronic betting assistant. As received, the electronic betting assistant can be positioned and secured to be substantially flush or planar with a table surface of the gaming table. In one embodiment, an electronic betting assistant is configured to receive bets from one player, and in such case, the gaming table would typically include a plurality of electronic betting assistants, such as one for each player position at the gaming table.

Although the electronic betting assistant 450 shown in FIG. 4B does not include one or more proximate sensors, the electronic betting assistant 450 could also include one or more other sensors, such as proximity sensors, optical, infrared sensors, etc. Data from the one or more other sensors are provided to the controller 456. The other sensors generally can be any sensor that can assist the electronic betting assistant 450 in detecting or recognizing an object. The object being detected is preferably the gaming objects, but it is not necessary that the nature of the object be known.

Figure 4C:
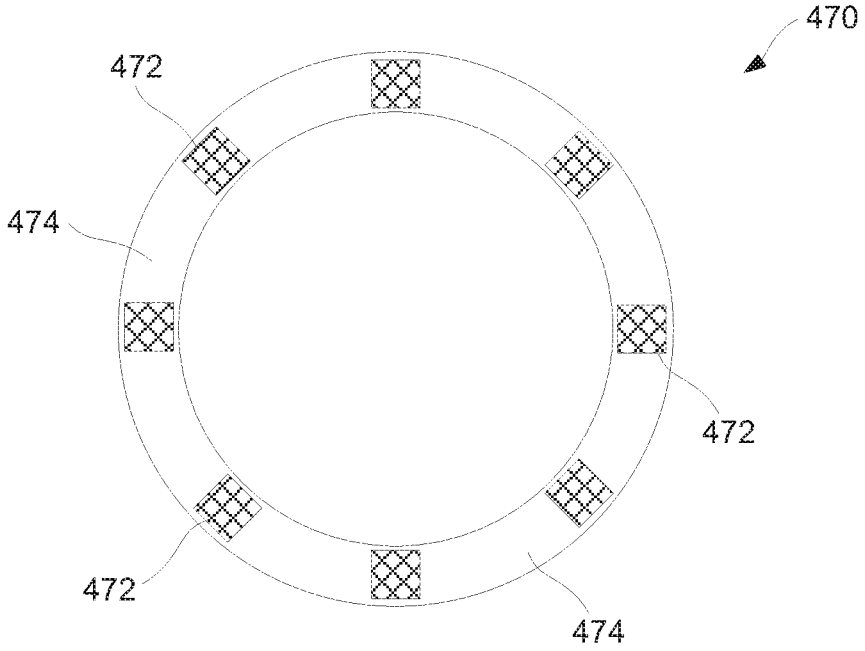
FIG. 4C is an illustration of a light ring according to one embodiment.

FIG. 4C is an illustration of a light ring 470 according to one embodiment. The light ring 470 represents one embodiment of the visual indicators 458 shown in FIG. 4B. The light ring 470 provides a plurality of visual indicators, which in one embodiment are light elements 472. The light elements 472 can, for example, be Light Emitting Diodes (LEDs). The light elements 472 can be commonly controlled or individually controlled. The light produced by the light elements 472 can be of a predetermined color or can be controlled to yield different colors. The light ring 470 can be provided around a display, such as a round display.

Figure 4D:
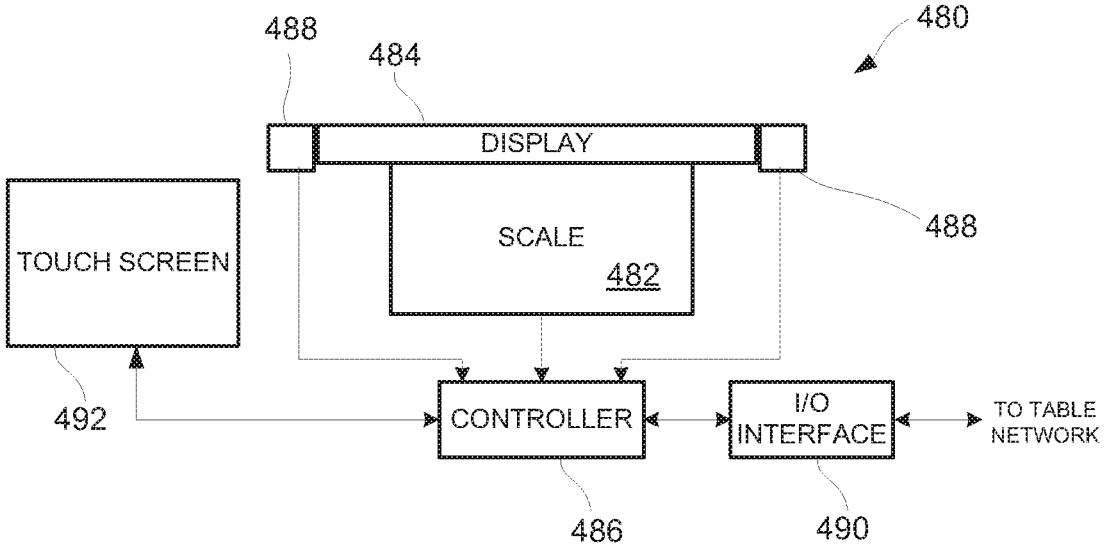
FIG. 4D is block diagram of an electronic betting assistant according to one embodiment.

FIG. 4D is block diagram of an electronic betting assistant 480 according to one embodiment. The electronic betting assistant 480 is suitable for use as any of the electronic betting assistants 116 illustrated in FIG. 1, the electronic betting assistant 214 illustrated in FIG. 2, or the electronic betting assistant 302 illustrated in FIG. 3.

The electronic betting assistant 480 includes a scale 482 for measuring a weight of one or more gaming objects. A display 484 is provided on the scale 482 to provide a display area where text and/or images can be displayed. The display 484 can also provide a top surface for receiving the one or more gaming objects associated with a given wager. In one embodiment, the display 484 can be a LCD display. For example, the display 484 can be a round display that has a diameter of 1-5 inches. However, in other embodiments, the display 484 can other shapes and sizes. The scale 482 is an electronic scale (or digital scale) that can provide an electrical output that is dependent on the weight of object(s) placed on the scale 482. In this embodiment, the display 484 can be secured on an upper weighing surface of the scale 482 so that the display 484 provides the top surface. Hence, placing object(s) on the display 484 also effectively places an object on the scale 482. Processing or calibration can be used to provide a weight offset or adjustment due to the weight of the display 484 appearing on the scale 482.

The electronic betting assistant 480 can also include a controller 486. The controller 486 is programmed or constructed to provide control over the electronic betting assistant 480. The controller 486 reads or receives a digital or analog weight value from the scale 482. The controller 486 can perform processing to validate the weight value. The controller 486 can also then perform processing to determine the corresponding money value of the given wager. Additional details on an electronic betting assistant or operation of its processor are discussed below.

Further, the electronic betting assistant 480 can also include one or more visual indicators 488. The one or more visual indicators 488 can provide visual notifications via the electronic betting assistant 480. In one implementation, the one or more visual indicators 488 can serve to illuminate a peripheral portion of the electronic betting assistant 480. For example, as depicted in FIG. 4D, the one or more visual indicators 488 can be coupled to or placed adjacent to an outer periphery of the display 484. In another alternative, the one or more visual indicators 458 can be integral or embedded in the display 484. The one or more visual indicators 458 can also be considered as an illuminable bezel for the display 484.

The electronic betting assistant 480 can also include an Input/Output (I/O) interface 490. The I/O interface 490 allows the electronic betting assistant 480 to electronically communicate with other electronic devices, such as over a network (e.g., a table network provided at a gaming table). The network can be a wired network or a wireless network.

The electronic betting assistant 480 further includes a touch screen 492. The touch screen 492 can be coupled to and controlled by the controller 486. The touch screen 492 can be used to display information to the player using the electronic betting assistant 480. For example, the displayed information can include information on a wager amount, wager confirmations, alerts, confirmation requests, winnings, etc.

As noted above, an electronic betting assistant can be provided with a gaming table. For example, an opening in a gaming table can receive the electronic betting assistant. As received, the electronic betting assistant can be positioned and secured to be substantially flush or planar with a table surface of the gaming table. In one embodiment, an electronic betting assistant is configured to receive bets from one player, and in such case, the gaming table would typically include a plurality of electronic betting assistants, such as one for each player position at the gaming table.

Although the electronic betting assistant 480 shown in FIG. 4D does not include one or more proximate sensors, the electronic betting assistant 480 could also include one or more other sensors, such as proximity sensors, optical, infrared sensors, etc. Data from the one or more other sensors are provided to the controller 486. The other sensors generally can be any sensor that can assist the electronic betting assistant 480 in detecting or recognizing an object. The object being detected is preferably the gaming objects, but it is not necessary that the nature of the object be known.

Figure 5:
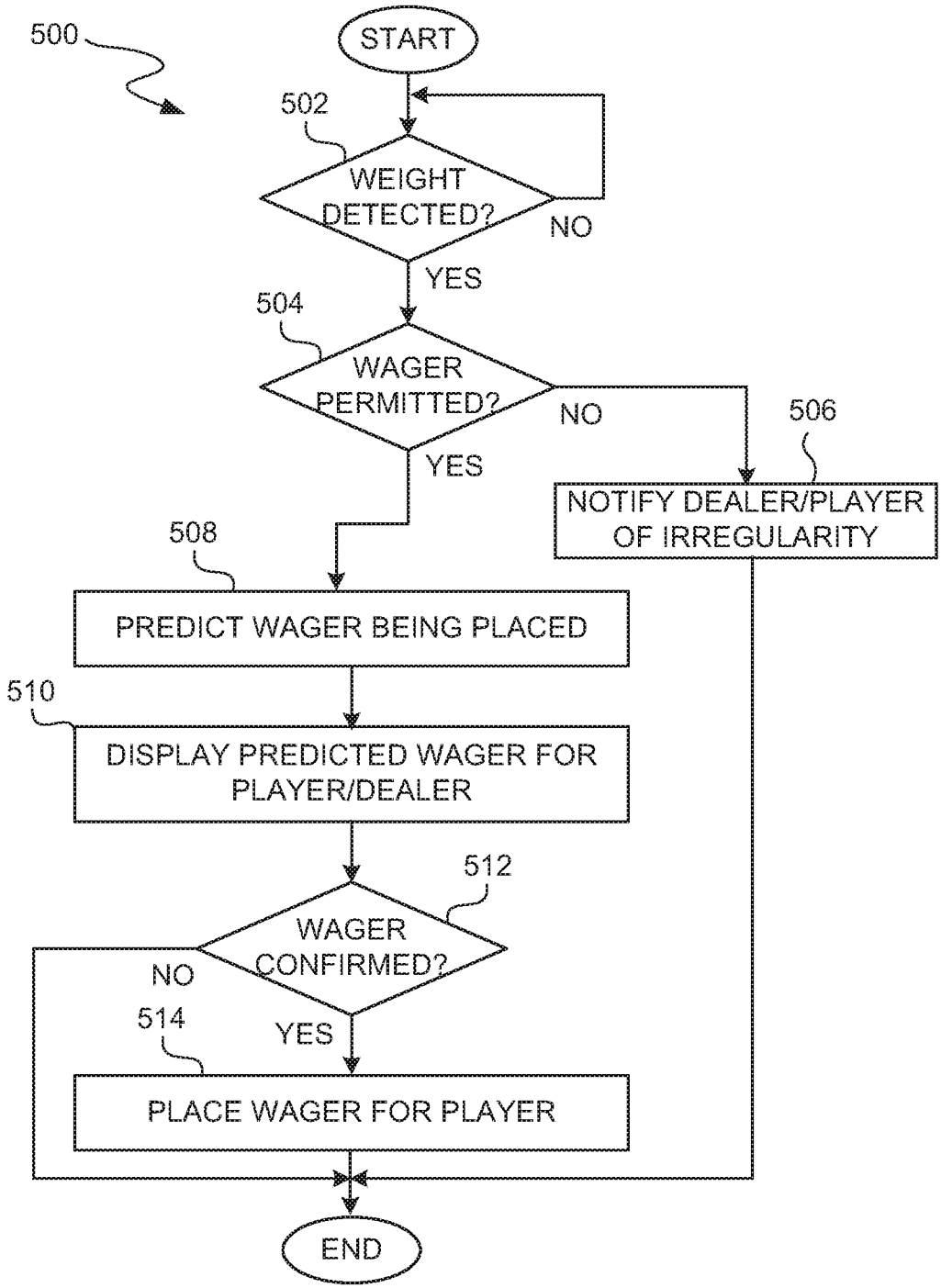
FIG. 5 is a flow diagram of a wager placement process according to one embodiment of the invention.

FIG. 5 is a flow diagram of a wager placement process 500 according to one embodiment of the invention. The wager placement process 500 can be performed by an electronic or computing device, which for example can include the gaming apparatus control system 118 illustrated in FIG. 1 or the gaming apparatus control system 200 illustrated in FIG. 2, but which may also include or interact with other electronic devices or appliances, such as an electronic betting assistant, of or used with a gaming apparatus or an electronic management system.

The wager placement process 500 can begin with a decision 502 that determines whether a weight has been detected. Here, for example, a weight can be detected by an electronic scale that is part of the electronic betting assistant. For example, as noted above, an electronic scale can be provided with an electronic bet assistant. The weight being detected is associated with a wager (bet) being made by a player. The weight being detected is intended to be the weight of one or more gaming objects that the player has placed on the electronic scale as pertaining to the wager being placed. When the decision 502 determines that a weight has not been detected, the wager placement process 500 can await detection of such a weight.

On the other hand, when the decision 502 determines that a weight has been detected, the wager placement process 500 can continue. A decision 504 can then determine whether a wager is permitted. Wagers are typically associated with a wager-based game and normally a player can place a wager only at certain times relative to the play of the wager-based game. Hence, the decision 504 can evaluate whether the present state of the wager-based game permits the wager being attempted by the player. Additionally, the aggregate amount wagered may also affect the determination of whether a wager is permitted. For instance, some gaming tables will require a minimum bet. Other gaming tables might impose a maximum allowable bet depending on the casino, the time of day, the player's location (e.g., high-limit gaming areas), the player's available chips, or even the jurisdiction rules designed to control possible gambling issues. Thus, the determination might further include one or more of such wager limits. When the decision 504 determines that a wager is not permitted, a dealer and/or player can be notified 506 of the irregularity. For example, the irregularity can be that the wager being attempted to be placed is not presently permitted. Hence, the decision 504 can evaluate whether the present state of the wager-based game permits the wager being attempted by the player. If the wager is not presently permitted, the notification 506 can advise the player and/or dealer that the player is not permitted to make the attempted wager at this time. The player can be so advised by a display or visual indicators.

Alternatively, when the decision 504 determines that a wager is permitted, the wager placement process 500 can predict 508 the wager being placed. In one implementation, the prediction 508 of the wager is based at least in part on the weight detected. That is, the one or more gaming objects being placed on the electronic scale of the electronic betting assistant are weighed and that weight is used at least in part to predict 508 the wager being placed by the player. Then, the predicted wager is displayed 510 for the player and/or dealer. Next, a decision 512 can determine whether the wager has been confirmed. Here, the wager that is been predicted can be confirmed by one or both the dealer and the player. The confirmation of the wager provides for a reliable validation of the predicted wager. In one implementation, the predicted wager is displayed to player and/or dealer, and then, through user input, the player and/or dealer can confirm the wager being displayed. The display of the wager can be on or coupled to the electronic bet assistant, or the display can be a separate device (which can be an individual display or a shared displayed). The display can be LED, LCD or OLED based display technology. For example, such a display can be implemented by the display 484 and/or touch screen 492 shown in FIG. 4D.

When the decision 512 determines that the wager has been confirmed, the wager can be placed 514 for the player. Alternatively, when the decision 512 determines that the wager was not confirmed, then the wager is not placed for the player and the wager placement process 500 can end. Additionally, following the notification 506 as well as following the placement 514 of the wager, the wager placement process 500 can also end.

Figure 6A:
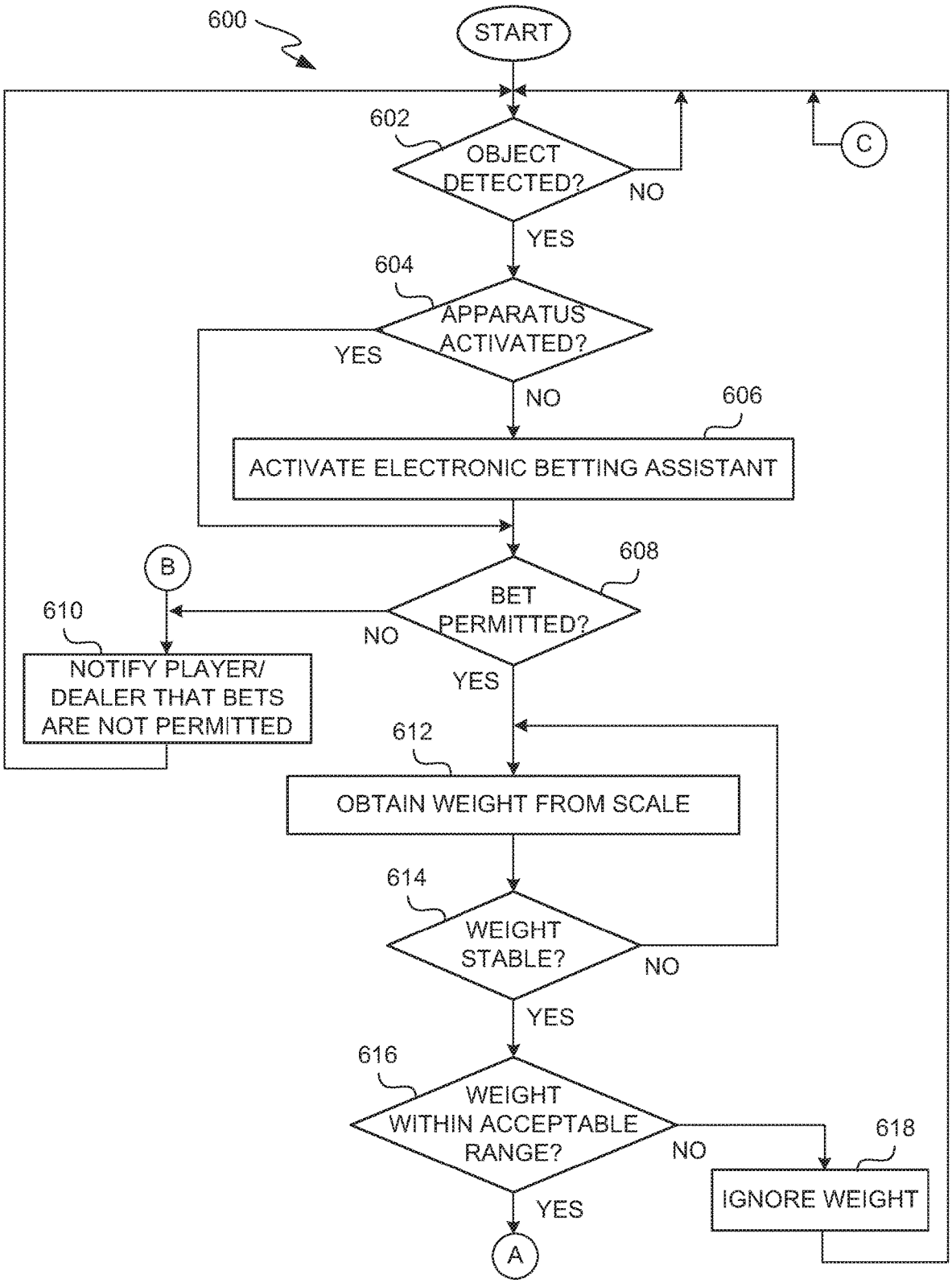
FIGS. 6A and 6B are flow diagrams of a wager placement process according to another embodiment of the invention.
Figure 6B:
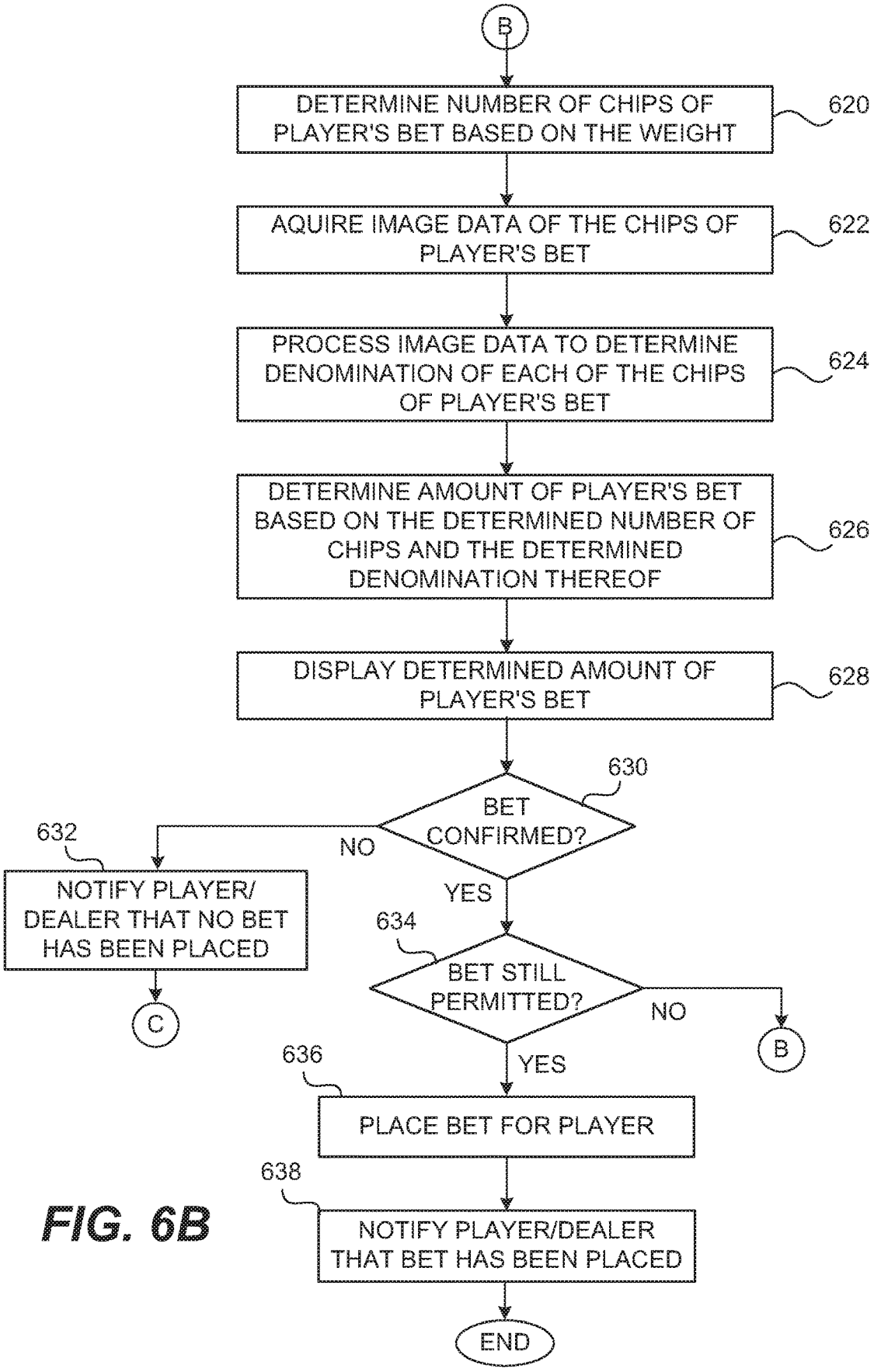

FIGS. 6A and 6B are flow diagrams of a wager placement process 600 according to another embodiment of the invention. The wager placement process 600 can be performed by an electronic or computing device, which for example can include the gaming apparatus control system 118 illustrated in FIG. 1 or the gaming apparatus control system 200 illustrated in FIG. 2, but which may also include or interact with other electronic devices or appliances, such as an electronic betting assistant, of or used with a gaming apparatus or an electronic management system.

The wager placement process 600 can begin with a decision 602 that determines whether an object has been detected. Typically, the one or more objects being detected are one or more gaming objects that can be utilized by a player to play a wager on a wager-based game. In one embodiment, the one or more objects can be detected using a sensor, such as a proximity sensor. For example, in one embodiment, the proximity sensor can be an optical sensor configured to detect presence of one or more objects. When the decision 602 determines that an object has not been detected, the wager placement process 600 can await for detection of such objects.

On the other hand, when the decision 602 determines that an object has been detected, a decision 604 can determine whether an electronic betting assistant, which supports chip-based betting, is activated. When the decision 604 determines that the electronic betting assistant is not presently activated, then the electronic betting assistant can be activated 606. Alternatively, when the decision 604 determines that the electronic betting assistant is already activated, the block 606 can be bypassed.

Following the block 606 or its being bypassed, a decision 608 can determine whether a bet is permitted. Typically, the bet being placed is associated with a wager-based game which only permits bets during certain states thereof. Additionally, the aggregate amount wagered may also affect the determination of whether a wager is permitted. For instance, some gaming tables will require a minimum bet. Other gaming tables might impose a maximum allowable bet depending on the casino, the time of day, the player's location (e.g., high-limit gaming areas), the player's available chips, or even the jurisdiction rules designed to control possible gambling issues. Thus, the determination might include these wager limits. Hence, the decision 608 can evaluate whether bets are presently permitted by the wager-based game. When the decision 608 determines that wagers are not presently permitted, the player and/or dealer can be notified 610 that bets are not at this time permitted. Such a notification can, for example, be implemented by the display 484 and/or touch screen 492 shown in FIG. 4D. After the player and/or dealer is notified 610, the wager placement process 600 can return to repeat the decision 602 and subsequent blocks so that the player is able to request additional wagers.

On the other hand, when the decision 608 determines that bets are presently permitted, the wager placement process 600 can obtain 612 a weight from an electronic scale. The electronic scale can produce a weight that corresponds to the weight of the one or more objects being detected at the decision 602. Next, a decision 614 can determine whether the weight is stable. Given the use of an electronic scale, it is probable that the weight will change as objects are placed on or removed from the scale. Hence, it can be desirable to wait for the weight to be stabilized so that the weight is a reliable indication of the one or more objects for the wager that is intended to be placed. When the decision 614 determines that the weight is not yet stable, the wager placement process 600 can return to repeat the block 612.

Once the decision 614 determines that the weight is stable, a decision 616 can determine whether the weight is within an acceptable range. Here, for enhanced reliability, the decision 616 can determine whether the weight of the one or more objects associated with the wager is within an acceptable weight range. For example, if the one or more gaming objects have a known weight, the combined weight of the objects being measured by the scale should have generally acceptable ranges depending upon the number of objects. By evaluating the weight relative to the acceptable range of weight for the permitted objects, processing can avoid false weight values, such as when other non-wagering objects are placed on the scale. In any event, went the decision 616 determines that the weight from the scale is not within an acceptable range, the weight can be ignored 618, and then the wager placement process 600 can return to repeat the decision 602 so that subsequent wagers can be attempted. A notification could also be provided to the dealer and/or player to advise of the irregularity. Such a notification can, for example, be implemented by the display 484 and/or touch screen 492 shown in FIG. 4D.

Alternatively, when the decision 616 determines that the weight is within an acceptable range, then a number of chips of the player's bet can be determined 620 based on at least the weight. Here, in this embodiment, the objects associated with the player's bet are chips, such as gaming chips associated with particular gaming establishments. These chips can have different denominations, such as $1, $5, $10, $20, $50 or $100. Since all such chips may have the same weight, it can be desirable to use additional sensor information when evaluating the value of the player's bet. Hence, the wager placement process 600 can also acquire 622 image data of the chips of the player's bet. The image data can be obtained by one or more cameras positioned to acquire images of the chips. After the image data of the chips of the player's bet has been acquired 622, the image data can be processed 624 to determine a denomination of each of the chips of the player's bet. The processing 624 can vary depending on implementation. For example, the processing 624 can identify chip by one or more of size, visual codes or patterns, and/or colors. Then, an amount of the player's bet can be determined 626 based on the determined number of chips of the player's bet and the determined denomination thereof. Thereafter, the determined amount of the player's bet can be displayed 628. For example, such a display can be implemented by the display 484 and/or touch screen 492 shown in FIG. 4D.

Next, a decision 630 can determine whether the bet being attempted by the player has been confirmed. The bet can be confirmed by one or both of the dealer and the player via user input. For example, a player might confirm using a touch screen such as the touch screen 492 shown in FIG. 4D and a dealer might confirm using a dealer terminal, such as the dealer terminal 218 shown in FIG. 2. When the decision 630 determines that the bet has not been adequately confirmed, the player and/or dealer can be notified 632 that no bet has been placed. Following the notification 632, the wager placement process 600 can return to repeat the decision 602 and subsequent blocks so that additional wagers can be attempted.

Alternatively, when the decision 630 determines that the bet has been sufficiently confirmed, a decision 634 can determine whether bets are still permitted. Here, similar to the decision 608, the decision 634 can determine whether the present state of the wager-based game permits bets to be made. If not, the wager placement processing 600 can decline the attempted wager and notify 610 the player and/or dealer that bets are presently not permitted, and thereafter return to repeat the decision 602 and subsequent blocks.

On the other hand, when the decision 634 determines that bets are still permitted, the bet can be placed 636 for the player. The player and/or dealer can then be notified 638 that the bet has been placed. The notification can, for example, be provided by a display or visual indicators. Following the notification 638, the wager placement process 600 can return to repeat the decision 602 and subsequent blocks so that additional wagers can be attempted.

Additionally, in one embodiment, an electronic device (e.g., computing device) and/or an electronic betting assistant can implement the decision 616 of one embodiment of the wager placement process 600 using a database. The database can include a data structure that stores weight values for chips of a plurality of different gaming establishments. Then, to evaluate a weight, the database can be accessed to retrieve known weight values for a chip from the particular gaming establishment where the wager-based gaming that the player is attempting to bet on resides. Hence, this can provide greater precision and reliability, as the weight detected can be more precisely processed to eliminate unreliable weights and/or evaluated for its value. The chips (i.e., different denominations of the chips) may or may not be all of the same weight, color and/or size. The different denominations of chips may also have different patterns or visual identifiers. The data structure within the database can include various characteristics for the chips (or other gaming objects), such as size, color, patterns, codes, etc. The processing 624 and/or determination 628 can make use of one or of other the distinguishing characteristics for the chips to enable the wager placement process 600 to reliably predict the amount of the player's bet. For example, infrared or radio frequency characteristics embedded in the chips.

In another embodiment, additional processing can be performed after a bet has been placed to monitor for bet changes after such bet has been placed. For example, the additional processing can monitor detected weight of the one or more objects of the player's bet to monitor for bet changes, namely, (i) removal of any of the one or more objects of the previously accepted player's bet or (ii) addition of one or more objects to the previously accepted player's bet. A dealer and/or player can be altered to such changes so that such bet changes, if unauthorized, can be corrected or prevented.

Figure 6C:
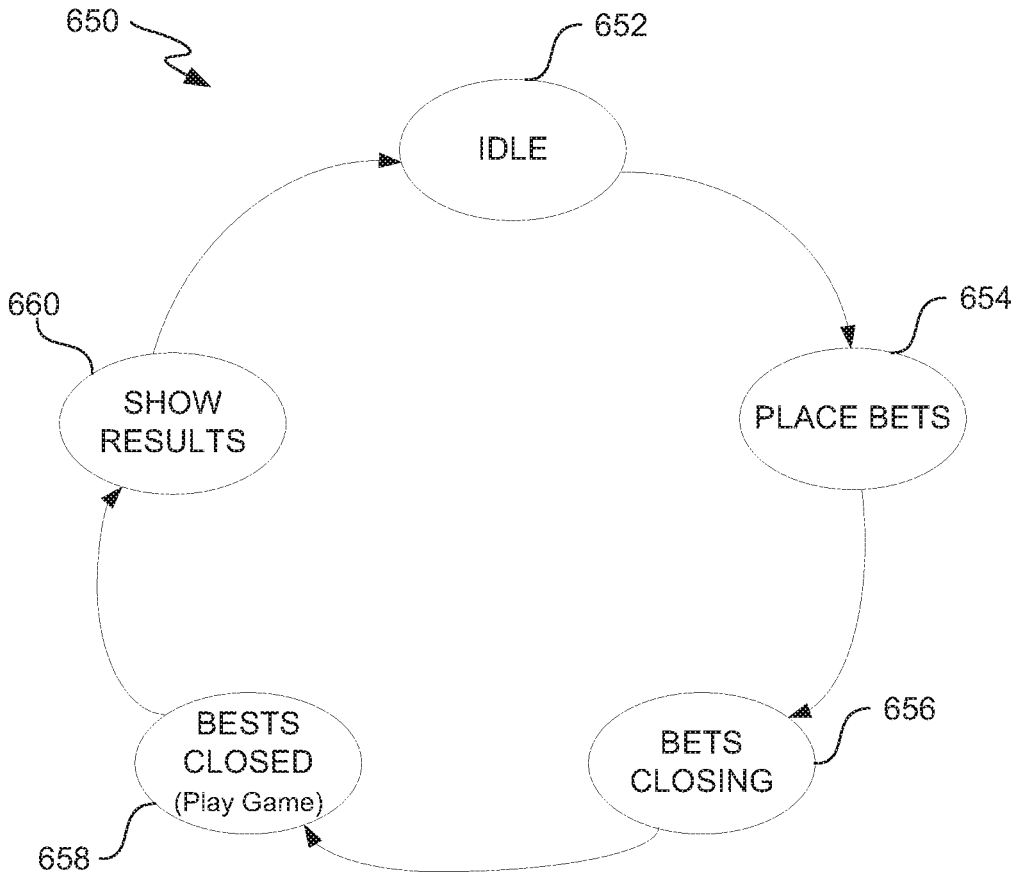
FIG. 6C is a state diagram of a gaming apparatus control system according to one embodiment.

FIG. 6C is a state diagram of a state diagram 650 used by a gaming apparatus control system according to one embodiment. The gaming apparatus control system can, for example, be the gaming apparatus control system 200 illustrated in FIG. 2. The state machine 650 can be used to control operation of an electronic betting assistant, such as the electronic betting assistant 214 illustrated in FIG. 2.

The state machine 650 includes an idle state 652, a place bets state 654, a bets closing state 656, a bets closed state 658, and a show results state 660. The state machine 650 can initially start in the idle state 652. Then, when the betting assistant is permitted to receive bets, the state machine 650 can proceed to the place bets state 654. While in the place bets state 654, the betting assistant assists a player in making a bet. Typically, the betting assistant is only able to receive bets during certain periods of time, which depends upon a state of the associated wager-based game. At some point after the state machine 650 has been placed in the place bets state 654, the state machine 650 will proceed to the bets closing state 656 when the time for placing bets on the associated wager-based game is almost ending. In the bets closing state 656, the player can be alerted that the ability to place bets will soon and. When the ability to place bets has closed, the state machine 650 proceeds to the bets closed state 658. At the bets close state 658, any bets that have been previously placed can be processed and played by way of the associated wager-based game. Following the bets closed state 658 and associated game play, the state machine 650 can proceed to the show results state 660. At the show results state 660, the player can be alerted to the results of the bet that they have placed. The results can indicate whether or not the bet was successful and, if successful, how much winnings were earned. Following the show results state 660, the state machine 650 can proceed to the idle state 652 until the next opportunity to place bets occurs.

As noted above, an electronic betting assistant can have a display and/or a notification display. The display can be implemented to be provided in a central region of the electronic betting assistant, or can be implemented as a separate display that is proximate to the electronic betting assistant. In another embodiment, the electronic betting assistant can be supported by both a display at the central region as well as another display proximate thereto. The notification display can be integral with or adjacent to the electronic betting assistant. In one embodiment, the notification display is a peripheral display device. The peripheral display device can be implemented as a peripheral lighting ring (i.e., light ring) having one or more LEDs to provide notification lighting (see, e.g., FIG. 4C).

TABLE 1

| System State | Displayed Content | Notification Lighting | Comments |
|---|---|---|---|
| Idle | Advertising or attracting content | Blue | Before new game starts |
| Place Bets | Attracting bets | Green | Bets able to be placed |
| Bets Closing | Count down | Yellow [flashing] | Bet window about to close |
| Bets Closed | Dark | Yellow | Bets can no longer be placed |
| Show Results | Result of associated game | Blue [flashing] | Game completed |

Table 1 is a table indicating exemplary displayed content and notification lighting for different states of a state machine of a gaming apparatus control system or an electronic betting assistant. In general, the displayed content and/or notification lighting can vary depending on state of an associated state machine, such as the state machine 650 shown in FIG. 6C. It should, however, be recognized that the displayed content and/or notification lighting can vary with implementation. In one embodiment, the display content can represent content displayed on a central display and/or an adjacent display, such as the display 484 and the touch screen 492, respectively, shown in FIG. 4D. In one embodiment, the notification lighting can represent notification provided by one or more lighting elements, such as the visual indicators 488 shown in FIG. 4D. In the idle state, the displayed content can be advertising content or content designed to attract attention. In the place bets state, the displayed content can be content designed to encourage betting. In the bets closing state, the displayed content might display a count down (e.g., 10 seconds, 9 seconds, 8 seconds, . . . ). The place bets state and the bets closing state can together represent a permitted bet window when bets are permitted. In the bets closed state, the displayed content can be dark (e.g., black). In the show results state, the displayed content can display result of the associated game which was being bet on. In the idle state, the notification lighting can be blue. In the place bets state, the notification lighting can be green. In the bets closing state, the notification lighting can be flashing yellow. In the bets closed state, the notification lighting can be yellow. In the show results state, the notification lighting can be flashing blue.

Figure 7:
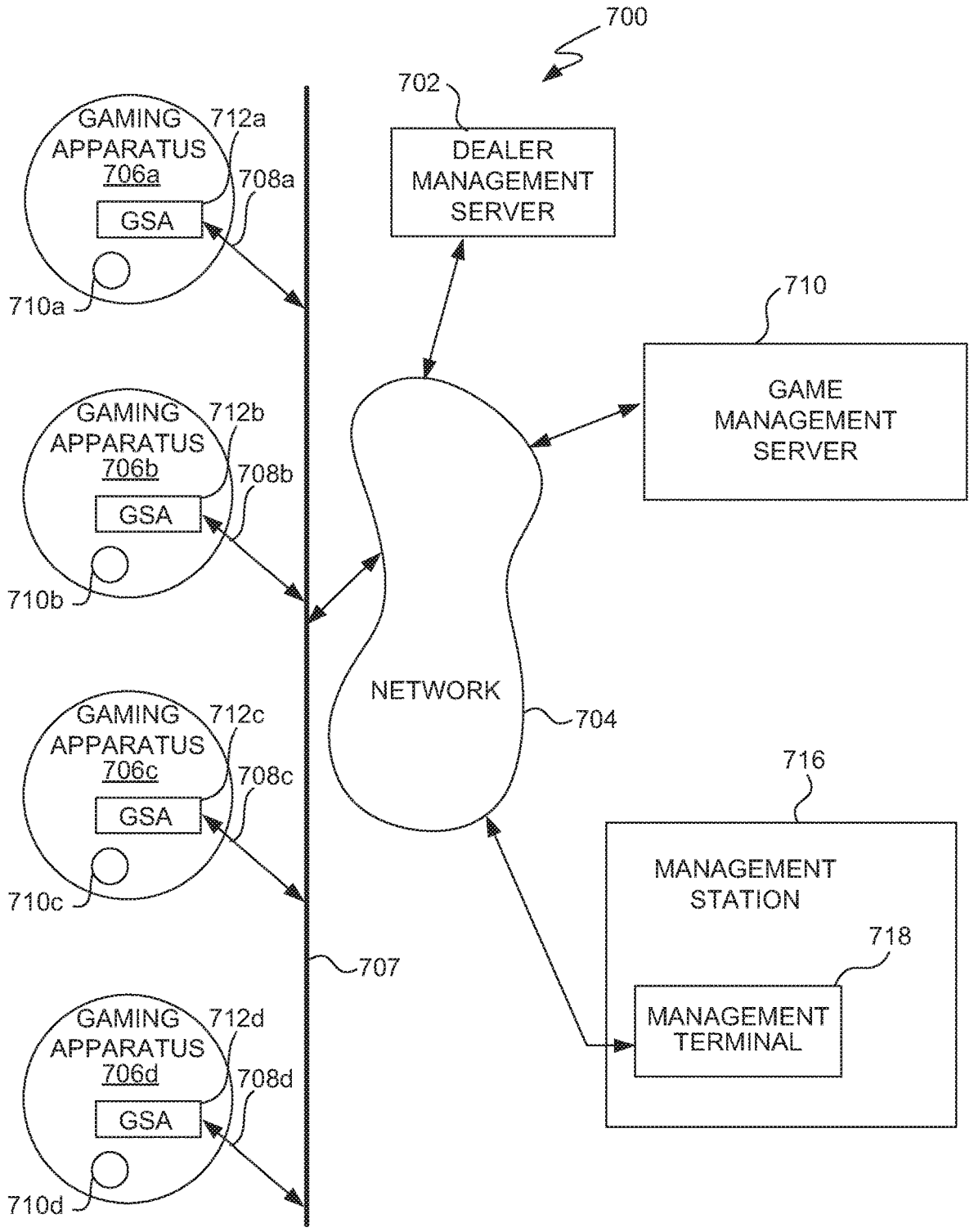
FIG. 7 is a block diagram of an electronic management system according to one embodiment.

FIG. 7 is a block diagram of an electronic management system 700 according to one embodiment. The electronic management system 700 serves to provide dealer and gaming apparatus control within a gaming environment.

The electronic management system 700 includes a dealer management server 702 that provides backend processing for the electronic management system 700. The dealer management server 702 is coupled to at least one network 704. The network 704 can be a global network, a local area network, and/or any combination of wired and/or wireless networks. The electronic management system 700 supports a plurality of gaming apparatus 706. In the embodiment illustrated in FIG. 7, the electronic management system 700 supports gaming apparatus 706*a*, gaming apparatus 706*b*, gaming apparatus 706*c*, and gaming apparatus 706*d*. The gaming apparatus 706*a*-706*d* can pertain to a game of chance, such as a wager-based game or a skill-based game, or some combination thereof. Examples of gaming apparatus include gaming tables and slot machines. The gaming apparatus 706*a* can couple to the network 704 by way of a main network link 707 and an apparatus network link 708*a*. Similarly, the gaming apparatus 706*b* can couple to the network 704 by way of the main network link 707 and an apparatus network link 708*b*; the gaming apparatus 706*c* can couple to the network 704 by way of the main network link 707 and an apparatus network link 708*c*; and the gaming apparatus 706*d* can couple to the network 704 by way of the main network link 707 and an apparatus network link 708*d*.

The gaming apparatus 706 can also include or make use of (e.g., couple to) a gaming support appliance (GSA) 712. The gaming support appliance 712 is an electronic device that is coupled or proximate to the gaming apparatus 706. In particular, the gaming apparatus 706*a*, 706*b*, 706*c* and 706*d* can respectively couple with the gaming support appliances 712*a*, 712*b*, 712*c* and 712*d*. The gaming support appliance 712 can, for example, pertain to an electronic betting assistant. The electronic betting assistant as the gaming support appliance 712 can be implemented in any of the various embodiments noted above.

The electronic management system 700 can further include a game management server 710. The game management server 710 can control or monitor game play at the gaming apparatus 706*a*, 706*b*, 706*c* and 706*d*. The management server 710 can interact with the gaming apparatus 706*a*. 706*b*, 706*c* and 706*d* via the network 704 for game play, game management, game regulation log, etc.

Furthermore, the electronic management system 700 can include a management station 716. The management station 716 provides information and tools to facilitate management of personnel or gaming apparatus. The management station 716 can include a management terminal 718. The management terminal 718 can be operatively connected to the network 704. The management terminal 718 can be used by personnel at the management station 716. The management terminal 718 can, for example, include or couple to a display device to present information for use by the personnel (e.g., management personnel). For example, the management terminal 718 can present information concerning a pending break or a shift change of dealers at a particular gaming apparatus. The information displayed can thus inform the management personnel that the particular gaming apparatus, or its dealer, is in need of a break or shift change. As another example, the management terminal 718 could be used to approve or decline a player's bet.

The management station 716 might also store or manage inventory for gaming supplies, and might receive and process an incoming re-supply request from a particular gaming apparatus. The information displayed can thus inform personnel that the particular gaming apparatus, or its dealer, is in need of re-supply of particular gaming supplies.

The electronic management system 700 can also be implemented together with a logistic management system, such as detailed in U.S. patent application Ser. No. 15/396,308, filed Dec. 30, 2016, and entitled "LOGISTIC MANAGEMENT OF GAMING SUPPLIES FOR GAMING ESTABLISHMENTS," which is hereby incorporated by reference. A logistics management system can provide active supply status data pertaining to the plurality of gaming apparatus 706. In this regard, the gaming apparatus 706 can make use of the gaming support appliance having the at least one electronic monitor to acquire the data pertaining to the status of supplies at the associated gaming apparatus 706. Such supply status data pertaining to the gaming apparatus 706 can be transmitted to the dealer management server 702 or a logistics management server (not shown) for storage in a transaction database or some other storage device. The supply status data can be provided to the dealer management server 702 or the logistic management server by the gaming apparatus 706 (or its gaming support appliance) in real-time or near real-time. For example, the supply status data could be provided whenever a change has been identified, on a periodic basis, or when manually or automatically triggered, or some combination thereof. A logistics management system can also interact with a supply repository to track quantities of gaming supplies resident within the supply depository. The gaming supplies can include cash, cards and chips. The quantities of the gaming supplies at the supply depository can be monitored or recorded in any of a variety of different ways, including manual counting and data entry into a management terminal, or through use of electronic sensors using an electronic appliance, or some combination thereof.

An electronic gaming system, gaming management system or fulfillment system can be implemented or embodied in various ways. Examples of several embodiments are illustrated below in FIGS. 8-10. Features of various different embodiments discussed herein can be combined as desired.

Figure 8:
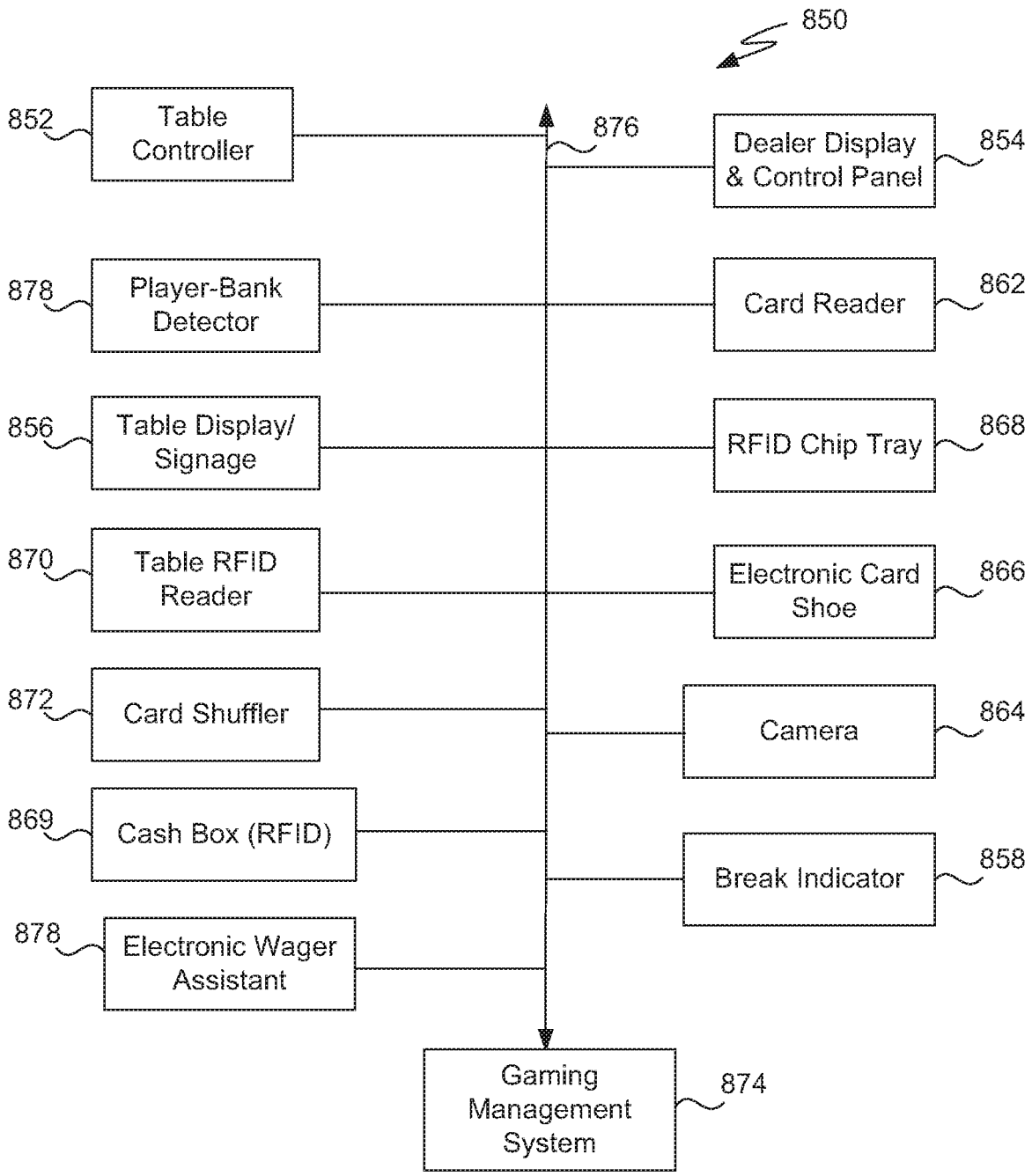
FIG. 8 illustrates a gaming apparatus according to one embodiment.

FIG. 8 illustrates a gaming apparatus 850 according to one embodiment. The gaming apparatus 850 includes various components that operate to facilitate playing of a wager-based game by one or more players. Often, the wager-based game is a card game and the gaming apparatus 850 provides a table for providing a playing surface. The gaming apparatus 850 can also include various electronic components to support playing and/or managing play of wager-based games at the gaming apparatus 850.

The gaming apparatus 850 can include a table controller 852. The table controller 852 can control overall operation of the gaming apparatus 850. For example, the table controller 852 can monitor games, cards, chips, wagers, dealers and/or players as well as receive and send data to a remote gaming management system 874 via a network. 876. The gaming apparatus includes various electronic components that can couple to the table controller 852 via the network 876. The network 876 can be wired and/or wireless, and can include one or more networks. Typically, the gaming management system 874 is associated with an establishment where the gaming apparatus 850 is present. The table controller 852 can also participate in controlling access (by dealers or others) to the gaming apparatus 850 and or its associated gaming supplies. In other words, the table controller 852 can lock and unlock the gaming apparatus. In one embodiment, the gaming apparatus 850 can provide or support the various operational states of a game of chance being provided at the gaming apparatus 850. The game of chance can be a wager-based game, a skill-based game, or some combination thereof. Examples of gaming apparatus include gaming tables, slot machines, portable gaming devices, and the like.

The gaming apparatus 850 can include a dealer display and control panel 854. The dealer display and control panel 854 can, for example, correspond to the dealer terminal 110 discussed above regarding FIG. 1 or the dealer terminal 218 discussed above regarding FIG. 2. The dealer display and control panel 854 can provide a control panel that a dealer can interact with to operate the gaming apparatus 850. In one implementation, the dealer display and control panel 854 can be a touch screen control panel. The dealer display and control panel 854 can enable the dealer to login or authenticate, deal, request or exchange gaming supplies, order other services for the dealer or patrons (e.g. beverage requests), and the like.

The gaming apparatus 850 can also include a table display/signage 856. The table display/signage 856 can be implemented as a community display that can display information to interest to persons, such as players, and/or managers of dealers (e.g., pit bosses). As an example, the dealer shift change (or lockout) timer, betting timer or other information that may be of interest could be display on the table display/signage 856.

The gaming apparatus 850 can also include a break indicator 858. For example, the break indicator 858 can represent a visual indicator, such as a light (e.g., LED light), provided at the gaming apparatus 850. The break indicator 858 can clearly indicate whether or not the dealer at the gaming apparatus 850 is on a break. The break indicator 858 can be provided at the gaming apparatus 850 at one or more different positions. As one example, the break indicator 858 can be provided on an electronic card shoe. As another example, the break indicator 858 can be integral with the dealer display and control panel 854. As still another example, the break indicator 858 can be a stand-alone visual indicator, such as an LED light bar, that is controlled by the table controller 852.

The gaming apparatus 850 can also include an electronic card shoe 866 and a RFID chip tray 868. The electronic card shoe 866 can contain and release cards that are used in playing a wager-based card game at the gaming apparatus 850. In one embodiment, the electronic card shoe 866 can provide a locking function that can prevent cards from being removed (i.e., dealt), such as to control when the cards can be removed from the electronic card shoe 866. For example, the electronic card shoe 866 can be placed in a locked condition in which unauthorized users are unable to make use of cards from the electronic card shoe 866. In one embodiment, the electronic card shoe 866 can include a card reader 862. The card reader 862 is able to optically read the cards being removed (i.e., dealt) from the electronic card shoe 866. The data captured by the card reader 862 can be provided to the table controller 852 for monitoring of the distribution of cards from the electronic card shoe 866 in conjunction with playing of the wager-based card games at the gaming apparatus 850. The RFID chip tray 868 is one implementation of an electronic chip tray that can electronically monitor quantities of chips, markers, money, tokens, and the like within the electronic chip tray. The RFID chip tray 868 can also be coupled to the table controller 852. In one embodiment, the RFID chip tray 868 can be covered and/or locked to inhibit access to the items within the electronic chip tray, such as during lockdown of the gaming apparatus 850.

The gaming apparatus 850 can further include the table RFID reader 870. The table RFID reader 870 can be provided at the gaming apparatus 850, which can include a gaming table. The table RFID reader 870 can utilize short range radio signals to monitor game play and/or gaming supplies at the gaming apparatus 850. The table RFID reader 870 can include or interact with the RFID chip tray 868.

The gaming apparatus 850 can include a cash box 869 that can receive and store cash. In one embodiment, the cash box 869 can be a RFID cash box. The cash box 869 can include a lockout function to prevent utilization of the cash box 869 by unauthorized users or unauthorized times. The cash box 869 can be controlled by the table controller 852.

The gaming apparatus 850 can also include at least one camera 864. The camera 864 can be utilized record game status as well as to monitor gaming supplies, such as chips and cards, with respect to the gaming apparatus 850. The camera 864 can also be utilized to receive or archive player decisions, monitor card shuffling, monitor game play, etc.

The gaming apparatus 850 can further include a card shuffler 872. The card shuffler 872 can operate to automatically shuffle cards for use at the gaming apparatus 850. For example, in one implementation, the gaming apparatus 850 includes a gaming table in which a wager-based card game is played. The card shuffler 872 can shuffle the cards in an automated fashion. The card shuffler 872 can also be coupled to or integrated with the electronic card shoe 866.

Further still, in one embodiment, the table controller 852 can also provide interaction with one or more electronic wager assistants 878 so that wagers from players can be received and validated/confirmed before being placed. The electronic wager assistants 878 can be constructed and utilized as discussed in various embodiment herein.

Additionally, the gaming apparatus 850 can also include one or more input components. In input component can be made available to a dealer or player. For example, a dealer can utilize an input component to login for authentication purposes. The input component can be coupled to the gaming apparatus 850 in general, or can be coupled to a particular component thereof, such as the electronic card shoe 866. The dealer can utilize the input component to login. For example, the input component can use a PIN entry, biometric reader, a magnetic card/fob reader, RFID token reader, and the like.

Figure 9:
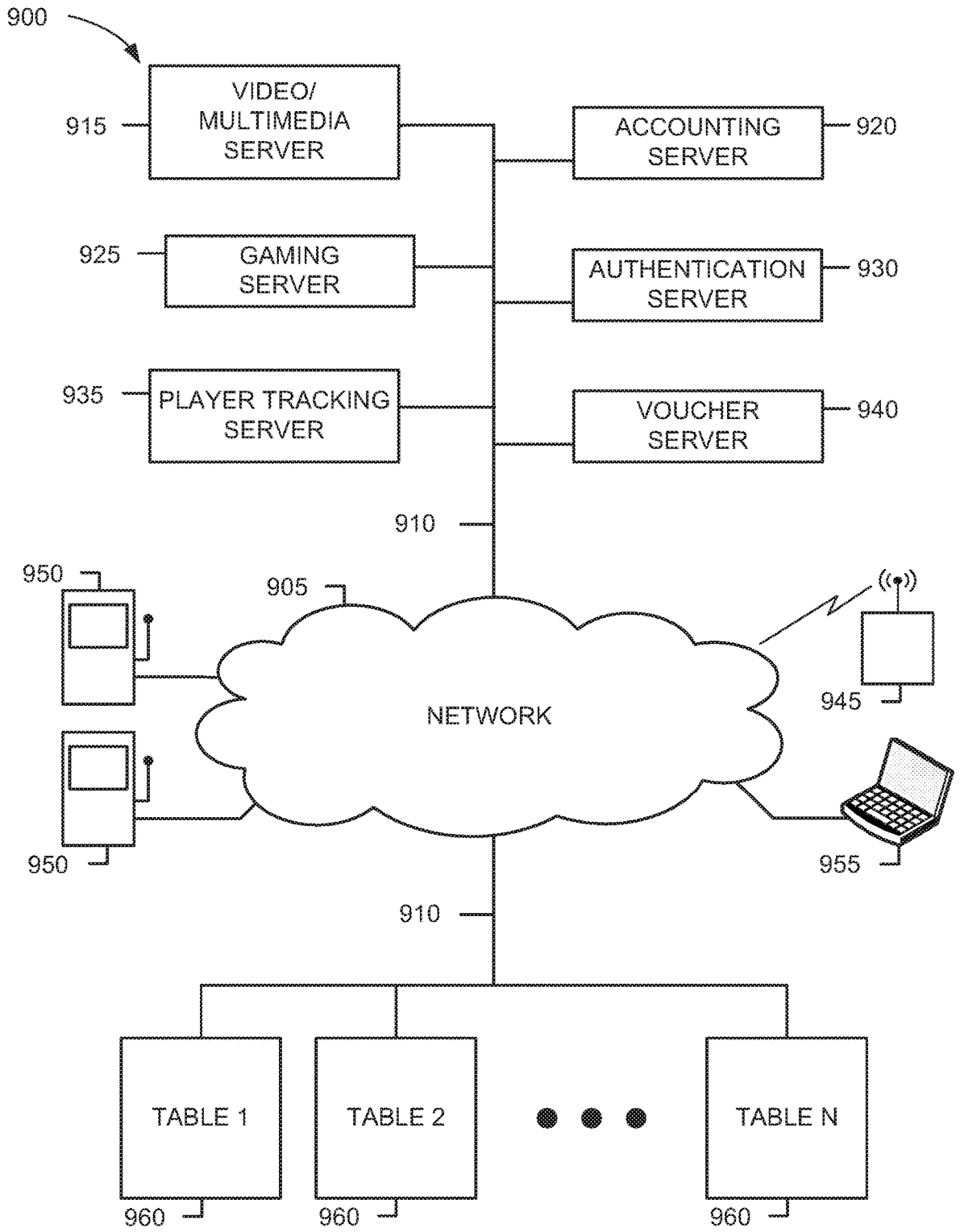
FIG. 9 illustrates an electronic gaming system according to one embodiment.

FIG. 9 illustrates an electronic gaming system 900 according to one embodiment. The electronic gaming system 900 may include electronic gaming tables 960, which may be coupled to a network 905 via a network link 910. The electronic gaming tables 960 may be gaming tables with enhanced electronic capabilities. The network 905 may be or include one or more of a public and a private network. One or more video streams may be received at a video/multimedia server 915 from the electronic gaming tables 960. The video/Multimedia server 915 may transmit one or more of these video streams to a mobile device 945, a gaming device 950, a laptop 955, and/or any other remote electronic device. The video/multimedia server 915 may transmit these video streams via the network link 910 and the network 905.

The electronic gaming system 900 may include an accounting/transaction server 920, a gaming server 925, an authentication server 930, a player tracking server 935, and a voucher server 940.

The accounting/transaction server 920 may compile, track, store, and/or monitor cash flows, voucher transactions, winning vouchers, losing vouchers, and/or other transaction data for the casino operator and for the players. Transaction data may include the number of wagers, the size of these wagers, the date and time for these wagers, the identity of the players making these wagers, and the frequency of the wagers. The accounting/transaction server 920 may generate tax information relating to these wagers. The accounting/transaction server 920 may generate profit/loss reports for predetermined gaming options, contingent gaming options, predetermined betting structures, and/or outcome categories.

The gaming server 925 may generate gaming options and/or outcomes based on predetermined betting structures and/or outcome categories. These gaming options may be predetermined gaming options, contingent gaming options, and/or any other gaming option disclosed herewith.

The authentication server 930 may determine the validity of vouchers, players' identity, and/or an outcome for a gaming event.

The player tracking server 935 may track a player's betting activity, a player's preferences (e.g., language, drinks, font, sound level, etc.), and other player actions or data. Based on data obtained by the player tracking server 935, a player may be eligible for gaming rewards (e.g., free play), promotions, and/or other awards (e.g., complimentary food, drinks, lodging, concerts, etc.).

The voucher server 940 may generate a voucher, which may include credit data or data relating to gaming options. For example, a voucher can be provided that represent a credit value and can be redeemed for game play or cash out. As another example, data relating to the structure (e.g., 6 out of the next 10 rolls at craps table 4 will be a 7 or 11) may be generated. If there is a time deadline, that information may be generated by the voucher server 940. Vouchers may be physical (e.g., paper) or digital.

Figure 10:
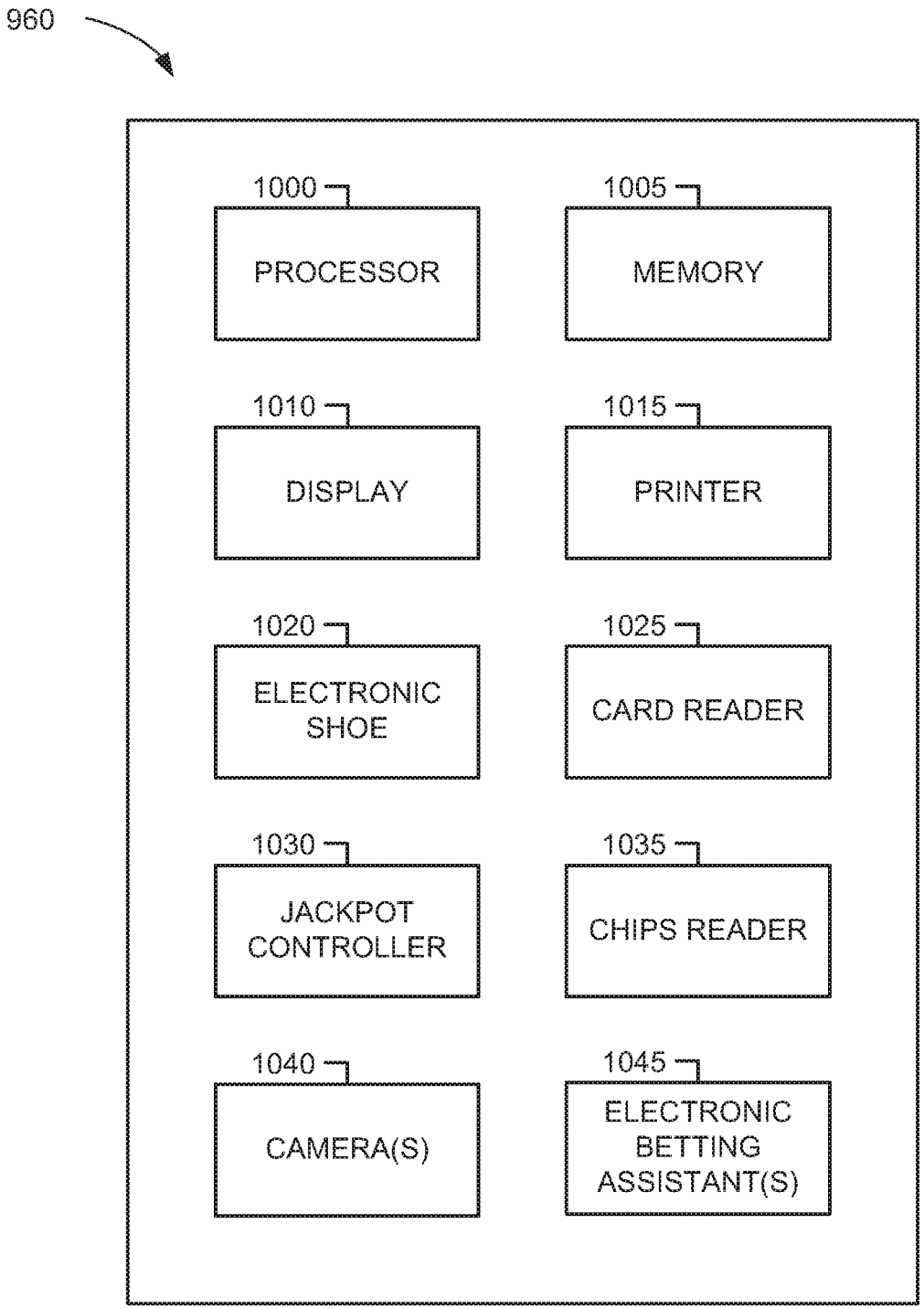
FIG. 10 shows electronic gaming table with various features, according to one embodiment.

FIG. 10 shows electronic gaming table 960 with various features, according to one embodiment. The electronic gaming table 960 can represent any of the one or more electronic gaming tables shown in FIG. 9. The electronic gaming table 960 may include a processor 1000, a memory 1005, a display 1010, a printer 1015, an electronic shoe 1020, a card reader 1025, a jackpot controller 1030, a chips reader 1035, one or more cameras 1040, and one or more electronic betting assistants 1045.

The processor 1000 may be communicatively coupled to any other device in the electronic gaming table 960. The processor 1000 via an interface may communicate, wired or wireless, with any of the elements of the electronic gaming system 1100.

The memory 1005 may include data relating to gaming events, video streams transmitted from the electronic gaming table 960, winning and losing percentages for gaming options relating to the electronic gaming table 960, and game management data (e.g., dealer schedule, chip refills, etc.).

The display 1010 may show previous game results, a betting structure, outstanding bets, transaction volume, present value of betting options, a table minimum bet, a table maximum bet, game state, betting window status, or any other data.

The printer 1015 may generate vouchers, promotional items, food tickets, event tickets, chip/cash vouchers, card vouchers and/or lodging tickets. Vouchers may be physical (e.g., paper) or digital.

The electronic shoe 1020 may obtain data and/or images of gaming objects utilized with the electronic gaming table 960. This data and/or images may be transmitted to electronic gaming devices and displayed as images from table games. For example, on a blackjack table a ten of spades may be dealt to a player. This information is obtained via the electronic shoe 1020 and utilized to generate an image and/or illustration of a ten of spades card, which maybe shown as images from table games displayed at the gaming tables 960 and/or mobile devices 945, gaming devices 950, laptops 955. In another example, electronic shoe 1020 may receive data relating to numbers on dice, transmit this data to electronic gaming system, which may be utilized to generate an image/illustration of the dice by electronic gaming system (e.g., images from table games displayed at electronic gaming tables 960 and/or mobile device 945, a gaming device 950, a laptop 955).

The card reader 1025 may provide identification, authentication, and application processing functions. The card reader 1025 may interface with smart cards, magnetic striped card, bar code reader, RFID card, and the like.

The jackpot controller 1030 may track and compile data associated with a jackpot. The jackpot controller 1030 may award the jackpot on a specific occurrence (e.g., dealing a royal flush) and/or randomly award a jackpot.

The chips reader 1035 may compile and track data associated with the amount of chips one or more players possesses, the amount of chips won/lost at the gaming table 960, the amount of chips in the dealer's rack at the gaming table 960, an amount of chips bet by one or more players, amount of chips in the betting pool, and/or any combination thereof.

The camera 1040 may obtain data from the electronic gaming table 960. The camera 1040 may be one or more cameras located to view the gaming objects (e.g., cards, dice, dominos, chips, ball, wheel, etc.), the dealer, the shoe, the players' hands, the players, wagers (bets) and/or any combination thereof. The camera 1040 may transmit this data to the electronic gaming table 960, which may be utilized to generate an image/illustration of the gaming objects.

The electronic betting assistant 1045 can be provide at the electronic gaming table 960 to assist with placement of wagers (bets). The wagers can be electronically evaluated to determine a value of a player's wager. The wager can be on a wager-based game played locally at the electronic gaming table 960 or remotely at another gaming device. The wager can pertain to a primary bet, a side bet, a back bet, or an auxiliary bet. The construction and operation of the electronic betting assistant 1045 can use any of the above described embodiments for such apparatus, where such embodiments can be used individually or in any combination.

The various aspects, features, embodiments or implementations of the invention described above can be used alone or in various combinations.

Embodiments of the invention can, for example, be implemented by software, hardware, or a combination of hardware and software. Embodiments of the invention can also be embodied as computer readable code on a computer readable medium. In one embodiment, the computer readable medium is non-transitory. The computer readable medium is any data storage device that can store data which can thereafter be read by a computer system. Examples of the computer readable medium generally include read-only memory and random-access memory. More specific examples of computer readable medium are tangible and include Flash memory, EEPROM memory, memory card, CD-ROM, DVD, hard drive, magnetic tape, and optical data storage device. The computer readable medium can also be distributed over network-coupled computer systems so that the computer readable code is stored and executed in a distributed fashion.

Numerous specific details are set forth in order to provide a thorough understanding of the present invention. However, it will become obvious to those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

In the foregoing description, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A wagering table for supporting wager-based table games, said wagering table comprising:

a table surface providing a gaming surface for a wager-based table game, the table surface supporting a plurality of player positions provided about the table surface;

a table controller supporting the wager-based table game; and a plurality of electronic bet assistants, each of the electronic bet assistants being at least partially integrated into the table surface at or proximate to a corresponding one of the player positions, wherein each of the electronic bet assistants includes at least:

an electronic scale;

a visual output apparatus configured to provide a visual notification at the corresponding one of the player positions;

a bet assistant controller operatively connected to the electronic scale; and a communication interface, operatively connected to the bet assistant controller, for communicating with the table controller of said wagering table, and wherein, for each of the electronic bet assistants, the visual output apparatus is positioned vertically over and mechanically coupled to the electronic scale.

2. The wagering table as recited in claim 1, wherein the bet assistant controller monitors the electronic scale to enable acceptance and confirmation of a bet made using at least one of the electronic bet assistants.

3. The wagering table as recited in claim 1, wherein the bet assistant controller monitors the electronic scale to enable a bet to be made during a permitted betting window using at least one of the electronic bet assistants.

4. The wagering table as recited in claim 1, wherein said wagering table comprises:

a display device configured to display a graphical user interface that presents an estimated bet and permits the corresponding player to confirm the bet amount.

5. The wagering table as recited in claim 4, wherein the bet assistant controller monitors the electronic scale to detect bet changes after the bet has been confirmed.

6. The wagering table as recited in claim 1, wherein the electronic bet assistant comprises:

a presence sensor operatively connected to the bet assistant controller, the presence sensor detecting presence of an object on at least a portion of the electronic bet assistant.

7. The wagering table as recited in claim 1, wherein the electronic bet assistant comprises:

an optical sensor operatively connected to the bet assistant controller.

8. The wagering table as recited in claim 1, wherein the visual output apparatus comprises a touch screen.

9. The wagering table as recited in claim 1, wherein the visual output apparatus comprising a plurality of individually controllable lighting elements.

10. The wagering table as recited in claim 1, wherein the visual output apparatus has a ring-shape.

11. The wagering table as recited in claim 1, wherein each of the electronic bet assistants has a housing that at least partially contains at least the electronic scale, the visual output apparatus, the bet assistant and the communication interface.

12. The wagering table as recited in claim 1, wherein each the electronic bet assistants provides one or more notifications using the visual output apparatus.

13. The wagering table as recited in claim 1, wherein the notifications include a betting permitted notification and a betting closed notification.

14. The wagering table as recited in claim 1, wherein the visual output apparatus comprises a display provided as a top surface of the electronic bet assistant.

15. The wagering table as recited in claim 1, wherein the electronic bet assistant comprises:

another electronic scale operatively connected to the bet assistant controller.

16. The wagering table as recited in claim 1, wherein the visual notification provided by the visual output apparatus includes a betting now permitted notification, a betting not now permitted notification, or a bet placed notification.

17. A computer-implemented method for assisting a player of a wager-based game in wagering one or more objects on the wager-based game, the method comprising:

detecting a first weight of a first set of the one or more objects, on a first electronic bet assistant associated with the player, that the player intends to wager on the wager-based game, the first electronic bet assistant being provided at a player bet area of a gaming table, and the first electronic bet assistant having a display screen and a digital scale, wherein the display screen is positioned vertically over and mechanically coupled to the digital scale;

determining whether the wager-based game is presently accepting first wagers on the wager-based game;

permitting the player to make a first wager on the wager-based game when the determining determines that the wager-based game is presently accepting first wagers on the wager-based game;

detecting a second weight of a second set of the one or more objects, on a second electronic bet assistant associated with the player, that the player intends to wager on the wager-based game, the second electronic bet assistant being provided at the player bet area of the gaming table;

determining whether the wager-based game is accepting second wagers on the wager-based game;

permitting the player to make a second wager on the wager-based game when the determining determines that the wager-based game is accepting second wagers on the wager-based game;

estimating the first wager that the player intends to wager on the wager-based game based on at least the first weight of the first set of the one or more objects; and estimating the second wager that the player intends to wager on the wager-based game based on at least the weight of the second set of the one or more objects.

18. The computer-implemented method as recited in claim 17, wherein the method comprises:

receiving a confirmation of the first wager based on the estimating of the first wager; and accepting the first wager from the player, the first wager being based on the estimating of the first wager provided that the confirmation of the first wager has been received, and further provided that the permitting permits the player to make the first wager.

19. The computer-implemented method as recited in claim 17, wherein the method comprises:

subsequently monitoring the first weight of the first set of the one or more objects for a change in weight that indicates that one or more of the first set of the one or more objects have been removed or added.

20. The computer-implemented method as recited in claim 19, wherein the wager-based game is a wager-based table game operating on the gaming table, and wherein the first wager is a primary wager, and wherein the second wager is a secondary or auxiliary wager.

21. The computer-implemented method as recited in claim 20, wherein a dealer manages the wager-based table game, and wherein the method comprises:

notifying the dealer if the monitoring indicates that one or more of the first set of the one or more objects have been removed or added, at least after the first wager from the player has been accepted.

22. The computer-implemented method as recited in claim 17, wherein the method comprises:

displaying the first wager as determined by the estimating of the first wager, and receiving a confirmation of the first wager in response to the displaying of the first wager as determined by the estimating of the first wager.

23. The computer-implemented method as recited in claim 17, wherein the wager-based game is a wager-based table game operating on a wagering table, wherein the wagering table is operated by a live dealer, and wherein the wagering table is resident at a gaming establishment that utilizes chips for wagering, and wherein the one or more of the objects are chips.

24. The computer-implemented method as recited in claim 17, wherein the method comprises:

presenting a notification that indicates that the wager-based game is presently not accepting first wagers when the determining determines that the wager-based game is presently not accepting first wagers on the wager-based game.

25. A method for assisting a player of a wager-based game in wagering one or more objects on the wager-based game, the method comprising:

detecting presence of one or more objects at a player bet area of a gaming table supporting play of the wager-based game, the player bet area of the gaming table having an electronic betting assistant at least partly embedded therein, wherein the electronic betting assistant having a display screen and a digital scale, wherein the display screen is positioned vertically over and mechanically coupled to the digital scale;

activating an electronic wager assistant for assisting the player to place a wager at the player bet area;

determining whether the wager-based game is presently accepting wagers on the wager-based game;

detecting, via the digital scale, a weight of the one or more objects that the player intends to wager on the wager-based game;

determining whether the weight detected is within an acceptable weight range;

determining a number of the one or more objects that the player intends to wager based on the weight detected;

acquiring image data of the one or more objects that the player intends to wager;

processing the image data to determine value of each of the one or more objects that the player intends to wager;

determining an amount of the wager that the player intends to wage based on the determined number of the one or more objects and the determined value of each of the one or more objects;

displaying, via the display screen, the determined amount of the wager; and subsequently determining whether the determined amount of the wager as displayed is confirmed by the player and/or an operator of the wager-based game.

26. The method as recited in claim 25, wherein the method comprises:

presenting a bet made notification indicating that the wager has been placed for the player.

27. The method as recited in claim 25, wherein the method comprises:

displaying the determined amount of the wager; and subsequently determining whether the determined amount of the wager as displayed is confirmed by the player and/or an operator of the wager-based game.

28. The method as recited in claim 27, wherein the method comprises:

placing the wager for the player in accordance with the determined amount of the wager if the determining determines that the determined amount of the wager as displayed is confirmed.

29. An electronic bet assistant, comprising:

an exposed outer surface having a display screen;

a digital scale coupled to the exposed outer surface, wherein the display screen is positioned vertically over and mechanically coupled to the digital scale;

at least one visual indicator provided proximate to the exposed outer surface;

a controller operatively connected to the digital scale and/or the at least one visual indicator; and an input/output interface, operatively connected to the controller, for communicating with another electronic device over a network, wherein the controller monitors the digital scale to enable a bet to be made, wherein the digital scale yields a weight of one or more objects that are placed on the exposed outer surface, and wherein the controller determines a money value of the one or more objects based at least in part by the weight of the one or more objects.

30. The electronic bet assistant as recited in claim 29, wherein each of the one or more objects is a chip associated with a gaming establishment where the electronic bet assistant is located.

31. The electronic bet assistant as recited in claim 29, wherein the display screen is configured to display notifications.

32. The electronic bet assistant as recited in claim 30, wherein the electronic bet assistant comprises:

an optical sensor operatively connected to the controller.

33. The electronic bet assistant as recited in claim 32, wherein the optical sensor detects presence of an object on the exposed outer portion of the electronic bet assistant.

34. The electronic bet assistant as recited in claim 29, wherein the electronic bet assistant comprises:

a proximity sensor operatively connected to the controller.

* * * * *